US006916774B2

(12) United States Patent
Trinh et al.

(10) Patent No.: US 6,916,774 B2
(45) Date of Patent: Jul. 12, 2005

(54) FABRIC COLOR CARE METHOD

(75) Inventors: Toan Trinh, Maineville, OH (US); Mary Vijayarani Barnabas, West Chester, OH (US); John William Smith, Farifield, OH (US); Helen Bernado Tordil, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/853,390

(22) Filed: May 25, 2004

(65) Prior Publication Data

US 2004/0220072 A1 Nov. 4, 2004

Related U.S. Application Data

(63) Continuation of application No. 09/807,365, filed as application No. PCT/US99/24925 on Oct. 22, 1999.

(60) Provisional application No. 60/105,375, filed on Oct. 23, 1998.

(51) Int. Cl.[7] ..... C11D 3/22; C11D 3/37

(52) U.S. Cl. ..... 510/287; 510/276; 510/279; 510/406; 510/466; 510/470; 510/499; 510/500; 510/504

(58) Field of Search ..... 510/287, 276, 510/279, 406, 466, 470, 499, 500, 504

(56) References Cited

U.S. PATENT DOCUMENTS

| | | | | |
|---|---|---|---|---|
| 3,372,048 A | | 3/1968 | Weissbein | |
| 3,567,364 A | | 3/1971 | James | |
| 4,643,919 A | | 2/1987 | Fu | |
| 4,931,195 A | | 6/1990 | Cao et al. | |
| 5,336,447 A | | 8/1994 | Clements | |
| 5,429,754 A | | 7/1995 | Lin et al. | |
| 5,686,376 A | * | 11/1997 | Rusche et al. | 502/329 |
| 5,767,062 A | | 6/1998 | Trinh et al. | |
| 5,804,219 A | | 9/1998 | Trinh et al. | |
| 5,932,253 A | | 8/1999 | Trinh et al. | |
| 5,977,055 A | * | 11/1999 | Trinh et al. | 510/515 |
| 6,077,818 A | * | 6/2000 | Baeck et al. | 510/374 |

FOREIGN PATENT DOCUMENTS

| | | |
|---|---|---|
| WO | WO 98/20098 | 5/1998 |
| WO | WO 98/38272 | 9/1998 |
| WO | WO 99/55736 | 11/1999 |
| WO | WO 99/55953 | 11/1999 |

OTHER PUBLICATIONS

Stuart M. Barlow, et al., Collaborative Test of Determination of Iodine Value in Fish Oils. 1. Reaction Time and Carbon Tetrachloride or Cyclohexane as Solvents, JOACS74, 1077–1083(1997), Journal of American Oil Chemists Society.

U.S. Appl. No. 09/797,365, filed Apr. 12, 2001, Trin et al.

* cited by examiner

*Primary Examiner*—Charles Boyer
(74) *Attorney, Agent, or Firm*—David V. Upite

(57) ABSTRACT

The present invention relates to fabric care methods for restoring and/or rejuvenating color of worn, faded fabric, by applying to said fabric a fabric color care composition which comprises: water soluble and/or water dispersible polymers; surfactant capable of forming a bilayer structure; and mixtures thereof. Optionally, the composition can contain other ingredients to provide additionally fabric care benefits, and/or to improve performance and formulatability. The composition is preferably applied as small particle size droplets, especially from spray container which preferably are in association with a set of instructions for use.

23 Claims, No Drawings

FABRIC COLOR CARE METHOD

CROSS REFERENCE TO RELATED APPLICATIONS

This application is a continuation of U.S. Ser. No. 09/807,365, filed Apr. 12, 2001 currently pending, which claims the benefit of the filing date of PCT International Application Serial No. PCT/US99/24925 filed Oct. 22, 1999, which claims the benefit of U.S. Provisional Application Ser. No. 60/105,375, filed Oct. 23, 1998.

TECHNICAL FIELD

The present invention relates to methods and articles for treating fabrics to improve fabric appearance, especially with regards to color of fabrics, especially those that have been worn and having a faded appearance.

BACKGROUND OF THE INVENTION

There is a continuous need for improved compositions, products, and methods that provide useful benefits to fabrics, especially clothing, such as maintaining and/or improving a good appearance, especially fabric color, especially for fabric that have been worn, through a simple and convenient application of a product.

Consumer commonly judges the desirability and wearability of a garment by many appearance criteria, such as, absence of color fading, absence of wrinkles, absence of soiling and staining, absence of damage such as pilling, and the like. It is preferable that these benefits are provided via simple and convenient consumer compositions, methods and products, to be applied in the consumer's home. These consumer compositions and products are preferably safe, and do not involve complicated and/or unsafe treatments and/or applications. Desirably they comprise treatments that are familiar to the consumers, such as spraying, soaking, adding to the wash cycle, adding to the rinse cycle, and/or adding to the drying cycle.

Many published fabric care compositions methods try to provide fabric maintenance benefits, e.g., keep fabric from, e.g., fading, wear, pilling, soiling, staining, shrinkage, and the like. However, fabric articles, such as clothing, that are worn and used will get damaged via, e.g., mechanical abrasion in use and in the laundry washing processes. The resulting worn, damaged fabric can have loosened fabric weave and pilling. Worn, damaged color fabric especially has a undesirable faded appearance. A common method that the consumer can practice to improve and/or restore the color of such worn, faded fabric is the use of fabric dyes. However, dyeing process done at home tend to result in color bleeding in the subsequent washes that can discolor other fabrics in the same wash. Furthermore, when the fabric color is not uniform, such as when the fabric has design with different colors and/or different tones of the same color, the use of fabric dyes is not desirable.

The present invention comprises methods that can be used to improve color fidelity, i.e., recover, restore, rejuvenate color of worn, damaged clothing upon a single application.

The present invention optionally can provide other fabric care benefits, such as wrinkle removal, pill prevention, anti-shrinkage, and fabric shape retention.

SUMMARY OF THE INVENTION

The present invention relates to methods for treating fabrics by direct application, primarily to the surface of the fabrics, of certain preferred fabric color care actives and compositions, and to articles of manufacture that facilitate the use such fabric color care compositions and other known fabric care compositions to restore and/or rejuvenate color of worn, faded color fabrics. The present invention also relates to the use fabric color care active and composition comprising said fabric color care active to restore and/or rejuvenate color of worn, faded color fabrics.

The fabric color care active that can provide the unobvious color restoration and/or rejuvenation benefit to the worn, faded fabric is characterized by its ability to reduce the three following properties of said fabric, namely, its reflectance, its Hunter L value, and its pill number.

Preferred fabric color care composition comprises an effective amount of fabric color care active preferably being selected from the group consisting of:

(A) water soluble and/or water dispersible polymer; said polymer is selected from the group consisting of: natural polymer; synthetic polymer; substituted materials thereof; derivatised materials thereof; and mixtures thereof;

(B) surfactant capable of forming a bilayer structure; and (C) mixtures thereof;

said composition optionally being essentially free of any material that would soil or discernible when dried on the fabric surface; and said composition optionally being substantially removed during subsequent cleaning cycles to prevent undesirable build-up of the active on the fabrics; and said composition additionally being essentially free of any material that would cause the treated fabric to feel unduly sticky, or "tacky" to the touch.

Said composition is applied to fabric in a positive step, e.g., spraying, dipping, and/or soaking processes, followed by a drying step to maximize the application and retention of the active to the surface of the fibers. Preferably the treatment is by spray and/or roller so that the active is primarily applied to the visible surface of the fabric. The present invention also preferably relates to the fabric care compositions incorporated into a spray dispenser, to create an article of manufacture that can facilitate treatment of fabric articles and/or surfaces with said compositions containing fabric color care active and other optional ingredients at a level that is effective, yet is preferably not discernible when dried on the surfaces.

Also, concentrated aqueous or solid, preferably powder, fabric color care compositions can be used to prepare such compositions for treating worn, faded and/or damaged fabric.

It is especially important that said article, or any container containing said composition, or concentrate used to prepare said composition have a set of instructions associated therewith to inform the consumer that the composition can provide the color restoration benefit for worn, damaged and faded color fabric. Without knowledge of the unobvious benefit that can be obtained, a consumer would be highly unlikely to treat the visible surface of the fabric, especially older fabrics, and might even discard the fabric when it could be substantially restored to near-new condition.

DETAILED DESCRIPTION OF THE INVENTION

The present invention relates to methods for treating fabrics by direct application, primarily to the surface of the fabrics, of certain preferred fabric color care actives and compositions, and to articles of manufacture that facilitate the use such fabric color care compositions and other known fabric care compositions to restore and/or rejuvenate color of worn, faded color fabrics. The present invention also relates to the use fabric color care active and composition comprising said fabric color care active to restore and/or rejuvenate color of worn, faded color fabrics.

The unobvious color restoration and/or rejuvenation benefit to the worn, faded fabric is characterized by the ability of the fabric color care active to change the three following properties of worn, faded black cotton (chino) twill test fabric (as defined hereinbelow) resulting in:

(A) a percentage reflectance reduction ΔR of at least about 3%, preferably at least about 5%, more preferably at least about 8%, and even more preferably at least about 10%;

(B) a Hunter L value reduction ΔL of at least about 0.5, preferably at least about 1.0, more preferably at least about 1.5; and even more preferably at least about 2.0; and (C) a percentage pill number reduction ΔP of at least about 10%, preferably at least about 20%, more preferably at least about 40%, and even more preferably at least about 80%.

The preferred fabric color care composition of the present invention comprises:

(A) an effective amount of fabric color care active for restoring and/or rejuvenating the color of worn, faded color fabric, said fabric color care active is preferably selected from the group consisting of water soluble and or dispersible polymer; substituted materials thereof; derivatised materials thereof; and mixtures thereof; surfactant capable of forming a bilayer structure; and mixtures thereof;

(B) optionally, an effective amount to provide olfactory effects of perfume;

(C) optionally, to reduce surface tension, and/or to improve performance and formulatability, an effective amount of surfactant;

(D) optionally, an effective amount to absorb malodor, of odor control agent;

(E) optionally, an effective amount, to kill, or reduce the growth of microbes, of antimicrobial active;

(F) optionally, an effective amount to provide improved antimicrobial action of aminocarboxylate chelator;

(G) optionally, an effective amount of antimicrobial preservative; and (H) optionally, an aqueous carrier;

said composition optionally being essentially free of any material that would soil or discernible when dried on the surfaces, and said composition optionally being substantially removed during subsequent cleaning cycles to prevent undesirable build-up of the active on the fabrics; and said composition additionally being essentially free of any material that would cause the treated fabric to feel unduly sticky, or "tacky" to the touch.

The preferred polymer is colorless, to minimize the change of hue and to improve the color fidelity.

The present invention relates to the application of an effective amount of a fabric color care active and/or fabric color care composition to fabric to modify the following fabric properties, namely, a reduction of reflectance, a lowering of the L value, and a reduction of the microfibril number, to reduce the loss of fabric color and/or to recover fabric color. It has not previously been recognized that the use of the above compositions can provide good color restoration and/or recovery.

Methods for Determining the Observed Color Restoration Benefit

The utility of a fabric color care active can be determined by the following simple screening test procedures. The desired fabric properties are determined using worn black chino (cotton) twill test fabric that is available from TESTFABRICS, Inc., West Pittston, Pa. Worn black cotton twill test fabric is obtained by treating new fabric through eight treatment cycles, each washing/drying treatment cycle comprises of one washing/rinsing cycle with the AATCC powder detergent, followed by two washing/rinsing cycles with clear water (without detergent), all cycles using 90° C. water in a Kenmore automatic clothes washer Model 110, followed by a drying cycle in a Kenmore automatic electric tumble dryer Model 110. The resulting test fabric is visibly worn and faded. Some worn fabric samples are retained for use as control worn fabrics. Other worn fabric samples are treated using the method of the present invention. The control and treated fabrics are examined visually and their properties are determined by the following three test procedures.

Reflectance

The reduction of reflectance of a fabric is determined using the optical measurement from the LabScan®XE instrument from Hunter Associates Laboratory, Inc, Reston, Va. The LabScan®XE is a full-scanning spectrophotometer with a wavelength range from 400 to 700 nanometer. The sample is illuminated by a xenon flash lamp and reflected light is collected by a 15-station fiber optic ring. For reflectance measurements, the diameter of opening in port is 50 mm. The illumination angle is 0° (normal) to the specimen. The viewing angle is 45° from normal via fiber optic ring.

The reflectance of the whole range of wavelength from about 420 nm to about 620 nm is measured for the black cotton twill test fabrics. For each wavelength in an increment of about 10 nm, the reflectance of the treated fabric (Rt) and that of the worn, untreated fabric (Ru) are measured. The percentage reduction of the reflectance for each wavelength is $$\Delta R = 100 \times \{(\Sigma Ru - \Sigma Rt)/\Sigma Ru\}\%$$

For a noticeable improvement and/or restoration of fabric color, ΔR should be a positive number and having a value of at least about 3%, preferably at least about 5%, more preferably at least about 8%, and even more preferably at least about 10%.

Hunter L Value

The rejuvenation/restoration of color of the worn/faded color fabric is found to correlate with a reduction in the Hunter L value as defined below. The reduction of the Hunter L value of a fabric is determined by also using the LabScan®XE instrument from the Hunter Associates Laboratory, Inc. According to its manual, the 0°/45° geometry of this instrument 'sees' the color the way the human eye sees color, its circumferential viewing reduces the effect of sample directionality by detecting light evenly from the entire measured surface, and its specular excluded mode measures the entire appearance of samples, including the color component and the geometric component (gloss and texture). In a cylindrical space all color sensations can be arranged according to the attributes lightness, hue, and chroma. Lightness (the L value) is an attribute having end points white (L value of 100) and black (L value of 0) and a continuous scale of greys between them. The internationally agreed upon system (*Commision Internationale de l'Eclairage*, CIE Publication No. 15, E-1.3.1, 1971) for converting instrument data into color data is the CIE system. The CIELAB formula and its associated color space are based on a coordinate system with coordinates L* for lightness, a* for redness-greenness and b* for yellowness-blueness.

Unlike normal color measurement, where all three values "L", "a" and "b" are measured, in the determination of the color restoration benefit of the current invention, only the "L" values are determined, without a consideration of the "a" and "b" values. The L values for the treated black cotton twill fabric, Lt, and that of the worn, untreated black cotton twill fabric, Lu, are measured. The reduction of the L value $$\Delta L = Lu - Lt$$

should be a positive number, and for an appreciable improvement of color, ΔL should have a value of at least about 0.5, preferably at least about 1.0, more preferably at least about 1.5.

Microfibril Number.

An image analysis system is used to estimate the number of pills on the untreated and treated black cotton twill fabrics that are used to define the observed color restoration benefit. The general setup and procedure are described in "Efforts to Control Pilling in Wool/Cotton Fabrics", Jeanette M. Cardamone, *Textile Chemist and Colorist,* 31, 27–31 (1999), incorporated herein by reference. The image analysis system that we used utilizes a light booth with a circular fluorescent light bulb. The bulb is just above the plane of the fabric. The fabric is put into the light booth via a drawer. To remove any wrinkle the fabric is held down at the edges by a Plexiglas clamp (imagine a Plexiglas book with a hole in the cover where the fabric shows through). The pills rise above the fabric and reflect light to the monochrome camera, which is mounted above. The camera and video frame grabber are adjusted so that the pills show up as bright, and the plane of the fabric shows up as dark. Then the image is thresholded, and the bright blobs (pills) are counted and sized. The image analysis is done using a custom macro written in the OPTIMAS image analysis software package, available at the Meyer Instruments, Inc., Houston, Tex. The "pill number" (Pt) for the treated black cotton twill fabric and that of the worn, untreated fabric (Pu) are determined. The percentage reduction of the pill number ΔP is $$\Delta P = 100 \times (Pu - Pt)/Pu\ \%$$

It is found that for an appreciable color restoration benefit provided by a fabric color care composition, ΔP should be a positive number and having a value of at least about 10%, preferably at least by about 20%, more preferably at least about 40%, and even more preferably at least about 80%.

It is highly desirable to use actives that provide other benefits such as reduction of wrinkles, maintenance of garment shape, soil release, etc., since the process used herein requires substantially complete treatment of the visible portions of the fabric with relatively high levels of active and a consumer will normally be reluctant to invest the time, money, and effort required to make sure that all areas are properly covered. It is known that the color restoration benefit can be achieved by use of rinse-added and dryer-added fabric softeners as taught by the applicants herein. However, the total of active required in the rinse is much greater since the active is applied to the fabric in depth, and even with the best dryer-added fabric softeners that are released from a carrier such as a flexible substrate, the distribution can be less than perfect the first time.

A preferred fabric color care active of the present invention comprises of water dispersible, preferably water soluble polymers. They can be natural, or synthetic polymers and can act by forming a film, and/or by providing adhesive properties. E.g., the present invention can optionally use film-forming and/or adhesive polymer to also impart shape retention to fabric, particularly clothing. By "adhesive" it is meant that when applied as a solution or a dispersion to a fiber surface and dried, the polymer can attach to the surface. The polymer can form a film on the surface, or when residing between two fibers and in contact with the two fibers, it can bond the two fibers together.

Natural Polymers

A preferred fabric color care active of the present invention include water soluble and/or water dispersible natural polymers which are derived from natural sources, preferably polysaccharides, oligosaccharides, proteins; substituted versions of said polymers; derivatised versions of said polymers; and mixtures thereof. The preferred polymer is colorless, to minimize the change of hue and to improve the color fidelity.

A preferred active is selected from the group consisting of polysaccharides; proteins; glycoproteins; glycolipids; substituted versions of said polymers; derivatised versions of said polymers; and mixtures thereof.

Synthetic Polymers

Another preferred fabric color care active of the present invention include water soluble and/or water dispersible synthetic polymers. The preferred polymer is colorless, to minimize the change of hue and to improve the color fidelity. Fabric color care synthetic polymer includes: homopolymer and copolymer containing hydrophilic monomers and/or hydrophobic monomers.

Another preferred fabric color care synthetic polymer includes: dimethylsiloxane silicones and their derivatives. A class of silicone derivatives that is also preferred in the present invention is silicone copolyols.

Surfactant Capable of Forming a Bilayer Structure

Surfactants capable of forming a bilayer structure are those that can form a vesicle or liposome. Surfactant capable of forming a bilayer structure is useful fabric color care active in the spray composition of the present invention. Said surfactant comprises natural and synthetic materials. An example of natural surfactant include the phospholipids. Nonlimiting examples of synthetic surfactants include fabric softening actives and sorbitan esters of long chain ($C_{16}$–$C_{18}$) fatty acids.

A preferred fabric color care composition for treating worn and/or faded fabric comprises an effective amount of said fabric color care active, and optionally, at least one adjunct ingredients selected from the group consisting of: perfume, odor control agent including cyclodextrin, antimicrobial active and/or preservative, surfactant, optical brightener, antioxidant, chelating agent including aminocarboxylate chelating agent, antistatic agent, dye transfer inhibiting agent, fabric softening active, static control agent, or mixtures thereof.

Cationic dye fixing agents are not preferred in the composition of the present invention, because these materials are based on quaternized nitrogen compound or on nitrogen compounds having a strong cationic charge which is formed in situ under the conditions of usage. These materials are often substantive to the fabric and attract the fugitive dyes in the subsequent wash and rinse cycles, and can discolor and/or change the color and/or hue of the treated color fabric. Enzymes are also not preferred in the composition of the present invention, specially in the spray compositions, because aerosolized particles containing enzymes often constitute a health hazard.

The composition is typically applied to fabric via a positive step, e.g., spraying, dipping, soaking and/or padding process to treat substantially all of the visible surface followed by a drying step, including the process comprising a step of treating or spraying the fabric with the fabric care composition either outside or inside an automatic clothes dryer followed by, or concurrently with, the drying step in said clothes dryer. The application can be done industrially by large scale processes on textiles and/or finished garments and clothing, or, preferably, in the consumer's home by the use of commercial product.

The fabric color care spray composition contains fabric color care active at a level of from about 0.01% to about 20%, typically from about 0.05% to about 10%, preferably from about 0.1% to about 5%, more preferably from about 0.2% to about 3%, even more preferably from about 0.3% to about 2%, by weight of the usage composition.

The present invention also relates to concentrated liquid or solid fabric color care compositions, which are diluted to form compositions with the usage concentrations, as given hereinabove, for use in the "usage conditions". Concentrated compositions comprise a higher level of fabric color care active, typically from about 1% to about 99%, preferably from about 2% to about 65%, more preferably from about 3% to about 25%, by weight of the concentrated fabric color care composition. Concentrated compositions are used in order to provide a less expensive product per use. When a concentrated product is used, i.e., when the fabric color care active is from about 1% to about 99%, by weight of the concentrated composition, it is preferable to dilute the composition before treating fabric. Preferably, the concentrated fabric care is diluted with about 50% to about 10,000%, more preferably from about 50% to about 8,000%, and even more preferably from about 50% to about 5,000%, by weight of the composition, of water.

The present invention preferably comprises articles of manufacture that use such fabric color care compositions. Thus the present invention relates to the compositions incorporated into a spray dispenser to create an article of manufacture that can facilitate treatment of fabric surfaces with said fabric care compositions containing a fabric color care active and other optional ingredients at a level that is effective, yet is not discernible when dried on the surfaces. The spray dispenser comprises manually activated and non-manual powered (operated) spray means and a container containing the fabric color care composition. For a non-manually operated sprayer, preferably battery powered for safety reasons in the home, the container is preferably the one sold in the store containing the fabric color care composition that is applied to the fabric, adapted to be used with the particular sprayer. The invention also comprises containers that are adapted for use with spray dispensers.

Preferably the articles of manufacture are in association with a set of instructions for how to use the composition to treat fabrics correctly, to obtain the desirable fabric care results, viz, color renewal, and, preferably, other additional fabric care benefits, such as wrinkle removal, wrinkle resistance, fiber strengthening/anti-wear, pill prevention, anti-shrinkage, soiling prevention and/or reduction, and/or fabric shape retention, including, e.g., the manner and/or amount of composition to used, and the preferred ways of checking for completeness of application, stretching and/or smoothing of the fabrics. Ironing and/or smoothing can help distribute the active over the surface and partially compensate for incomplete distribution. As used herein, the phrase "in association with" means the instructions are either directly printed on the container itself or presented in a different manner including, but not limited to, a brochure, print advertisement, electronic advertisement, and/or verbal communication, so as to communicate the set of instructions to a consumer of the article of manufacture. It is important that the instructions be as simple and clear as possible, so that using pictures and/or icons is desirable.

I. Composition

Fabric Color Care Active

The fabric color care spray composition contains fabric color care active at a level of from about 0.01% to about 20%, typically from about 0.05% to about 10%, preferably from about 0.1% to about 5%, more preferably from about 0.2% to about 3%, even more preferably from about 0.3% to about 2%, by weight of the usage composition.

The present invention also relates to concentrated liquid or solid fabric color care compositions, which are diluted to form compositions with the usage concentrations, as given hereinabove, for use in the "usage conditions". Concentrated compositions comprise a higher level of fabric color care active, typically from about 1% to about 99%, preferably from about 2% to about 65%, more preferably from about 3% to about 25%, by weight of the concentrated fabric color care composition. Concentrated compositions are used in order to provide a less expensive product per use. When a concentrated product is used, i.e., when the fabric color care active is from about 1% to about 99%, by weight of the concentrated composition, it is preferable to dilute the composition before treating fabric. Preferably, the concentrated fabric care is diluted with about 50% to about 10,000%, more preferably from about 50% to about 8,000%, and even more preferably from about 50% to about 5,000%, by weight of the composition, of water.

Typical rinse additive compositions contain a level of fabric color care active of from 0.05% to about 50%, preferably from about 1% to about 35%, more preferably from about 2% to about 18%, and even more preferably from about 3% to about 10%, by weight of the rinse added compositions.

Preferred color care active includes polymers which can act by forming a film, and/or by providing adhesive properties. By "adhesive" it is meant that when applied as a solution or a dispersion to a fiber surface and dried, the polymer can attach to the surface. The polymer can form a film on the surface, or when residing between two fibers and in contact with the two fibers, it can bond the two fibers together. E.g., the present invention can use film-forming and/or adhesive polymer to provide color restoration to worn, faded fabric. The present invention can optionally use film-forming and/or adhesive polymer to also impart shape retention to fabric, particularly clothing. Useful polymers include natural polymers, synthetic polymers, and mixtures thereof. These polymers are preferably colorless, to minimize the change of hue and to improve the color fidelity.

Water Soluble and Water Dispersible Natural Polymers

A fabric color care active useful in the present invention comprises water soluble and/or water dispersible polymers derived from natural sources, preferably selected from the group consisting of polysaccharides; proteins; glycoproteins; glycolipids; substituted versions thereof; derivatised versions thereof; and mixtures thereof.

Preferably the fabric color care active is selected from the group consisting of polysaccharides and proteins. Preferably, said polysaccharides have a molecular weight of from about 1,000 to about 2,000,000, more preferably from about 5,000 to about 1,000,000, and even more preferably from about 10,000 to about 300,000. Nonlimiting examples of water soluble/dispersible polysaccharides useful in the present invention includes the following:

(i) Heteropolysaccharides derived from the bark, seeds, roots and leaves of plants, which are divided into two distinct groups, namely, acidic polysaccharides described as gums, mucilages and pectins, and the neutral polysaccharides known as hemicelluloses, (ii) Algal polysaccharides including food-reserve polysaccharides (e.g., laminaran), structural polysaccharides (e.g., D-xylans, D-mannans), sulphated polysaccharides that are isolated from algae (e.g., carrageenan, agar), other algal mucilages which have similar properties and usually contain L-rhamnose, D-xylose, D-glucuronic acid, D- and L-galactose and D-mannose, (iii) Microbial polysaccharides, such as teichoic acids, cell wall peptidoglycans (mureins), extracellular polysaccharides, gram-positive bacterial capsular polysaccharides and gram-negative bacterial capsular polysaccharides.

(iv) Lipopolysaccharides, (v) Fungal polysaccharides, and (vi) Animal polysaccharides (e.g., glycogen, chitin).

A preferred fabric color care polysaccharide is hemicelluloses selected from the group consisting of L-arabino-D-galactan; D-gluco-D-mannan, D-galacto-D-gluco-D-mannan, partly acetylated (4-O-methyl-D-glucurono)-D-xylan, L-arabino-(4-O-methyl-D-glucurono)-D-xylan; substituted versions thereof; derivatised versions thereof; and mixtures thereof; and more preferably, arabinogalactan. Arabinogalactans are long, densely branched high-molecular weight polysaccharides. Arabinogalactan that is useful in the composition of the present invention has a molecular weight range of from about 5,000 to about 500,000, preferably from about 6,000 to about 250,000, more preferably from about 10,000 to about 150,000. These polysaccharides are highly branched, consisting of a galactan backbone with side-chains of galactose and arabinose units. Most commercial arabinogalactan is produced from western larch, through a counter-current extraction process. Larch arabinogalactan is water soluble and is composed of arabinose and galactose units in about a 1:6 ratio, with a trace of uronic acid. The molecular weights of the preferred fractions of larch arabinogalactan include one fraction in the range of from about 14,000 to about 22,000, mainly from about 16,000 to about 21,000, and the other in the range of from about 60,000 to about 500,000, mainly from about 80,000 to about 120,000. The fraction that has the average molecular weight of from about 16,000 to about 20,000 is highly preferred for use in direct applications to fabric, such as in spray-on products.

Cationic polysaccharides such as chitins are also useful in the present invention. Chitin, a linear polysaccharide consisting of N-acetyl-D-glucosamine, is widely distributed in nature, e.g., in the shells of crustaceans and insects, and in the cell wall of bacteria. Chemically, chitin is very similar to cellulose, differing only in the fact that chitin has an aminoacetyl group instead of hydroxyl group at C-2. In spite of the similarity in structure with cellulose, the chemical and physical properties of chitin are significantly different from those of cellulose.

Water Soluble/Dispersible Proteins

Nonlimiting examples of water soluble/dispersible proteins useful in the present invention includes: globular proteins, such as albumins, globulins, protamines, histones, prolamines and glutelins; low levels of fibrous proteins, such as elastin, fibroin and sericin; and conjugated proteins with one or more non-protein moieties such as carbohydrates, lipids, and phosphate residues. The proteins useful herein preferably do not include enzymes, specially in the spray compositions, because aerosolized particles containing enzymes often constitute a health hazard.

Water Soluble and Water Dispersible Synthetic Polymers

Water soluble and water dispersible synthetic polymers useful in the present invention are comprised of monomers. Some nonlimiting examples of monomers which can be used to form the synthetic polymers of the present invention include: low molecular weight $C_1$–$C_6$ unsaturated organic mono-carboxylic and polycarboxylic acids, such as acrylic acid, methacrylic acid, crotonic acid, maleic acid and its half esters, itaconic acid, and mixtures thereof; esters of said acids with $C_1$–$C_{12}$ alcohols, such as methanol, ethanol, 1-propanol, 2-propanol, 1-butanol, 2-methyl-1-propanol, 1-pentanol, 2-pentanol, 3-pentanol, 2-methyl-1-butanol, 1-methyl-1-butanol, 3-methyl-1-butanol, 1-methyl-1-pentanol, 2-methyl-1-pentanol, 3-methyl-1-pentanol, t-butanol, cyclohexanol, 2-ethyl-1-butanol, neodecanol, 3-heptanol, benzyl alcohol, 2-octanol, 6-methyl-1-heptanol, 2-ethyl-1-hexanol, 3,5-dimethyl-1-hexanol, 3,5,5-trimethyl-1-hexanol, 1-decanol, 1-dodecanol, and the like, and mixtures thereof. Nonlimiting examples of said esters are methyl acrylate, ethyl acrylate, t-butyl acrylate, methyl methacrylate, hydroxyethyl methacrylate, methoxy ethyl methacrylate, and mixtures thereof; amides and imides of said acids, such as N,N-dimethylacrylamide, N-t-butyl acrylamide, maleimides; low molecular weight unsaturated alcohols such as vinyl alcohol (produced by the hydrolysis of vinyl acetate after polymerization), allyl alcohol; esters of said alcohols with low molecular weight carboxylic acids, such as, vinyl acetate, vinyl propionate; ethers of said alcohols such as methyl vinyl ether; aromatic vinyl such as styrene, alpha-methylstyrene, t-butylstyrene, vinyl toluene, polystyrene macromer, and the like; polar vinyl heterocyclics, such as vinyl pyrrolidone, vinyl caprolactam, vinyl pyridine, vinyl imidazole, and mixtures thereof; other unsaturated amines and amides, such as vinyl amine, diethylene triamine, dimethylaminoethyl methacrylate, ethenyl formamide; vinyl sulfonate; salts of acids and amines listed above; low molecular weight unsaturated hydrocarbons and derivatives such as ethylene, propylene, butadiene, cyclohexadiene, vinyl chloride; vinylidene chloride; and mixtures thereof and alkyl quaternized derivatives thereof, and mixtures thereof. Preferably, said monomers are selected from the group consisting of vinyl alcohol; acrylic acid; methacrylic acid; methyl acrylate; ethyl acrylate; methyl methacrylate; t-butyl acrylate; t-butyl methacrylate; n-butyl acrylate; n-butyl methacrylate; isobutyl methacrylate; 2-ethylhexyl methacrylate; dimethylaminoethyl methacrylate; N,N-dimethyl acrylamide; N,N-dimethyl methacrylamide; N-t-butyl acrylamide; vinylpyrrolidone; vinyl pyridine; adipic acid; diethylenetriamine; salts thereof and alkyl quaternized derivatives thereof, and mixtures thereof.

Preferably, said monomers form homopolymers and/or copolymers that are water soluble or dispersible in water and have a molecular weight of at least about 500, preferably from about 1,000 to about 2,000,000, more preferably from about 4,000 to about 1,000,000, and even more preferably from about 10,000 to about 300,000 for some polymers.

Polymers useful in the present invention can comprise homopolymers and copolymers of hydrophilic monomers and hydrophobic monomers. The copolymer can be linear random or block copolymers, and mixtures thereof. The hydrophobic/hydrophilic copolymers typically have a hydrophobic monomer/hydrophilic monomer ratio of from about 5:95 to about 95:5, preferably from about 15:85 to about 85:15, more preferably from about 30:70 to about 75:25, by weight of the copolymer. The hydrophobic monomer can comprise a single hydrophobic monomer or a mixture of hydrophobic monomers, and the hydrophilic monomer can comprise a single hydrophilic monomer or a mixture of hydrophilic monomers. The term "hydrophobic" is used herein consistent with its standard meaning of lacking affinity for water, whereas "hydrophilic" is used herein consistent with its standard meaning of having affinity for water. As used herein in relation to monomer units and polymeric materials, including the copolymers, "hydrophobic" means substantially water insoluble; "hydrophilic" means substantially water soluble. In this regard, "substantially water insoluble" shall refer to a material that is not soluble in distilled (or equivalent) water, at 25° C., at a concentration of about 0.2% by weight, and preferably not soluble at about 0.1% by weight (calculated on a water plus monomer or polymer weight basis). "Substantially water soluble" shall refer to a material that is soluble in distilled (or equivalent) water, at 25° C., at a concentration of about 0.2% by weight, and are preferably soluble at about 1% by weight. The terms "soluble", "solubility" and the like, for purposes hereof, corresponds to the maximum concentration of monomer or polymer, as applicable, that can dissolve in water or other solvents to form a homogeneous solution, as is well understood to those skilled in the art.

Nonlimiting examples of useful hydrophilic monomers are unsaturated organic mono-carboxylic and polycarboxylic acids, such as acrylic acid, methacrylic acid, crotonic acid, maleic acid and its half esters, itaconic acid; unsaturated alcohols, such as vinyl alcohol, allyl alcohol; polar vinyl heterocyclics, such as vinyl pyrrolidone, vinyl caprolactam, vinyl pyridine, vinyl imidazole; vinyl amine; vinyl sulfonate; unsaturated amides, such as acrylamides, e.g., N,N-dimethylacrylamide, N-t-butyl acrylamide; hydroxyethyl methacrylate; dimethylaminoethyl methacrylate; salts of acids and amines listed above; and the like; and mixtures thereof. Some preferred hydrophilic monomers are acrylic acid, methacrylic acid, N,N-dimethyl acrylamide, N,N-dimethyl methacrylamide, N-t-butyl acrylamide, dimethylamino ethyl methacrylate, vinyl pyrrolidone, salts thereof and alkyl quaternized derivatives thereof, and mixtures thereof.

Nonlimiting examples of useful hydrophobic monomers are acrylic acid $C_1$–$C_{18}$ alkyl esters, such as methyl acrylate, ethyl acrylate, t-butyl acrylate; methacrylic $C_1$–$C_{18}$ alkyl esters, such as methyl methacrylate, 2-ethyl hexyl methacrylate, methoxy ethyl methacrylate; vinyl alcohol esters of carboxylic acids, such as, vinyl acetate, vinyl propionate, vinyl neodecanoate; aromatic vinyls, such as styrene, t-butyl styrene, vinyl toluene; vinyl ethers, such as methyl vinyl ether; vinyl chloride; vinylidene chloride; ethylene, propylene and other unsaturated hydrocarbons; and the like; and mixtures thereof. Some preferred hydrophobic monomers are methyl acrylate, methyl methacrylate, t-butyl acrylate, t-butyl methacrylate, n-butyl acrylate, n-butyl methacrylate, and mixtures thereof.

Some non-limiting examples of water soluble and water dispersible homopolymers include polyacrylic acid, polyacrylamide; polymethacrylic acid; polymethacrylamide; polyvinyl alcohol; polyvinyl acetate; polyvinylpyrrolidone; polyvinyloxazolidone; polyvinylmethyloxazolidone; polyethylene oxide; polypropylene oxide; polyvinylpyridine n-oxide; polyquaternary amine resins; poly (ethenylformamide); poly(vinylamine) hydrochloride; and mixtures thereof. Many of these polymers are described with more details in "Water-Soluble Synthetic Polymers: Properties and Behavior, Volume I, Philip Molyneux, published by CRC Press, 1983, incorporated herein by reference. Preferably said homopolymers are selected from the group consisting of polyvinyl alcohol; polyvinyl acetate; polyacrylic acid; polyacrylamide; polymethacrylic acid; polymethacrylamide; polyvinylpyrrolidone; polyvinyloxazolidone; polyethylene oxide; polypropylene oxide; polyvinylpyridine n-oxide; and mixtures thereof.

Some non-limiting examples of copolymers which can be used as fabric color care active of the present invention are: adipic acid/dimethylaminohydroxypropyl diethylenetriamine copolymer; adipic acid/epoxypropyl diethylenetriamine copolymer; poly(vinylpyrrolidone/dimethylaminoethyl methacrylate); methacryloyl ethyl betaine/methacrylates copolymer; ethyl acrylate/methyl methacrylate/methacrylic acid/acrylic acid copolymer; poly (vinyl alcohol-co-6% vinylamine); poly(vinyl alcohol-co-12% vinylamine); poly(vinyl alcohol-co-6% vinylamine hydrochloride); and poly(vinyl alcohol-co-12% vinylamine hydrochloride). Preferably, said copolymer are selected from the group consisting of adipic acid/dimethylaminohydroxypropyl diethylenetriamine copolymer; poly(vinylpyrrolidone/dimethylaminoethyl methacrylate); ethyl acrylate/methyl methacrylate/methacrylic acid/acrylic acid copolymer; methacryloyl ethyl betaine/methacrylates copolymer; polyquaternary amine resins; poly(ethenylformamide); poly(vinylamine) hydrochloride; poly(vinyl alcohol-co-6% vinylamine); poly(vinyl alcohol-co-12% vinylamine); poly(vinyl alcohol-co-6% vinylamine hydrochloride); and poly(vinyl alcohol-co-12% vinylamine hydrochloride).

Nonlimiting examples of the preferred polymer that are commercially available are: polyvinylpyrrolidone/dimethylaminoethyl methacrylate copolymer, such as Copolymer 958®, molecular weight of about 100,000 and Copolymer 937, molecular weight of about 1,000,000, available from GAF Chemicals Corporation; adipic acid/dimethylaminohydroxypropyl diethylenetriamine copolymer, such as Cartaretin F-4® and F-23, available from Sandoz Chemicals Corporation; methacryloyl ethyl betaine/methacrylates copolymer, such as Diaformer Z-SM®, available from Mitsubishi Chemicals Corporation; polyvinyl alcohol copolymer resin, such as Vinex 2019®, available from Air Products and Chemicals or Moweol®, available from Clariant; adipic acid/epoxypropyl diethylenetriamine copolymer, such as Delsette 101®, available from Hercules Incorporated; and polyvinylpyrrolidone/acrylic acid, such as Sokalan EG 310®, available from BASF.

Non limiting examples of polymers for use in the present invention include the following, where the composition of the copolymer is given as approximate weight percentage of each monomer used in the polymerization reaction used to prepare the polymer: vinyl pyrrolidone/vinyl acetate copolymers (at ratios of up to about 30% by weight of vinyl pyrrolidone); dimethyl acrylamide/t-butyl acrylate/ethyl hexyl methacrylate copolymer (10/45/45); vinyl pyrrolidone/vinyl acetate/butyl acrylate copolymer (10/78/12 and 10/70/20); vinyl pyrrolidone/vinyl propionate copolymer (5/95); vinyl caprolactam/vinyl acetate copolymer (5/95); acrylic acid/t-butyl acrylate (25/75) and styling resins sold under the trade names Ultrahold CA 8® by Ciba Geigy (ethyl acrylate/acrylic acid/N-t-butyl acrylamide copolymer); Resyn 28-1310® by National Starch and Luviset CA 66® by BASF (vinyl acetate/crotonic acid copolymer 90/10); Luviset CAP® by BASF (vinyl acetate/vinyl propionate/crotonic acid 50/40/10); Resyn 28-2930® by National Starch (vinyl acetate/vinyl neodecanoate/crotonic acid copolymer), Amerhold DR-25® by Union Carbide (ethyl acrylate/methacrylic acid/methyl methacrylate/acrylic acid copolymer), and Poligen A® by BASF (polyacrylate dispersion).

A preferred fabric color care active comprises copolymers contain hydrophobic monomers and hydrophilic monomers which comprise unsaturated organic mono-carboxylic and polycarboxylic acid monomers, such as acrylic acid, methacrylic acid, crotonic acid, maleic acid and its half esters, itaconic acid, and salts thereof, and mixtures thereof; and optionally other hydrophilic monomers. Examples of the hydrophilic unsaturated organic mono-carboxylic and polycarboxylic acid monomers are acrylic acid, methacrylic acid, crotonic acid, maleic acid and its half esters, itaconic acid, and mixtures thereof. Nonlimiting examples of the hydrophobic monomers are esters of the unsaturated organic mono-carboxylic and polycarboxylic acids cited hereinabove with $C_1$–$C_{12}$ alcohols, such as methanol, ethanol, 1-propanol, 2-propanol, 1-butanol, 2-methyl-1-propanol, 1-pentanol, 2-pentanol, 3-pentanol, 2-methyl-1-butanol, 1-methyl-1-butanol, 3-methyl-1-butanol, 1-methyl-1-pentanol, 2-methyl-1-pentanol, 3-methyl-1-pentanol, t-butanol, cyclohexanol, 2-ethyl-1-butanol, and mixtures thereof, preferably methanol, ethanol, 1-propanol, 2-propanol, 1-butanol, 2-methyl-1-propanol, t-butanol, and mixtures thereof. One preferred copolymer contains acrylic acid and t-butyl acrylate monomeric units, preferably with acrylic acid/t-butyl acrylate ratios of from about 90:10 to about 10:90, preferably from about 70:30 to about 15:85, more preferably from about 40:60 to about 20:80. Nonlimiting examples of acrylic acid/tert-butyl acrylate copolymers useful in the present invention are those typically with a molecular weight of from about 1,000 to about 2,000,000, preferably from about 5,000 to about 1,000,000, and more preferably from about 30,000 to about 300,000, and with an approximate acrylic acid/tert-butyl acrylate weight ratio of about 25:75 and an average molecular weight of from about 70,000 to about 100,000, and those with an approximate acrylic acid/tert-butyl acrylate weight ratio of about 35:65 and an average molecular weight of from about 60,000 to about 90,000.

A class of water-soluble polymers containing nitrogen and oxygen atoms useful in the present invention for fabric color restoration/rejuvenation can also be used as dye transfer inhibiting agents. These polymers have the ability to complex or adsorb the fugitive dyes washed out of dyed fabrics before the dyes have the opportunity to become attached to other articles in the wash or the rinse. Nonlimiting examples of these actives are polyvinylpyrrolidone polymers, poly(4-vinylpyridine-N-oxide), polyamine N-oxide polymers, copolymers of N-vinylpyrrolidone and N-vinylimidazole, polyvinyloxazolidones and polyvinylimidazoles or mixtures thereof. Examples of such dye transfer inhibiting agents are disclosed in U.S. Pat. No. 5,804,219, issued Sep. 8, 1998 to T. Trinh, S. L.-L. Sung, H. B. Tordil, and P. A. Wendland, and in U.S. Pat. Nos. 5,707,950 and 5,707,951, all are incorporated herein by reference.

Polyalkyleneterephthlate Copolymers

Another fabric color care active suitable in the present invention comprises block copolymers of polyalkylene terephthalate and polyoxyethylene terephthalate, and block copolymers of polyalkylene terephthalate and polyethylene glycol. The polyalkylene terephthalate blocks preferably comprise ethylene and/or propylene groups. Many such polymers are nonionic.

A preferred nonionic polymer has the following average structure:

$$CH_3O(CH_2CH_2O)_{40}—[C(O)—C_6H_4—C(O)—OCH_2CH(CH_3)O—]_s—C(O)—C_6H_4—C(O)—(OCH_2CH_2—)_{40}OCH_3.$$

Such polymers are described in U.S. Pat. No. 4,849,257, Borcher, Trinh and Bolich, issued Jul. 18, 1989. Another preferred nonionic polymer is described in New Zealand Pat. No. 242,150, issued Aug. 7, 1995 to Pan, Gosselink, and Honsa, said patents are incorporated herein by reference.

Other suitable polymers that are useful in the present invention comprise anionic and cationic polymers. Suitable anionic polymers or oligomers are disclosed in U.S. Pat. No. 4,018,569, Trinh, Gosselink and Rattinger, issued Apr. 4, 1989. Suitable cationic polymers are described in U.S. Pat. No. 4,956,447, Gosselink, Hardy, and Trinh, issued Sep. 11, 1990. Other suitable polymers are disclosed in U.S. Pat. No. 4,808,086, Evans, Huntington, Stewart, Wolf, and Zimmerer, issued Feb. 24, 1989. All said patents are incorporated herein by reference.

The above polyalkylene terephthalate copolymers can be used in the composition of the present invention to additionally provide a soil release benefit.

Silicones

Another preferred fabric color care active comprises silicones and their derivatives. Nonlimiting examples of useful silicones in the composition of the present invention include noncurable silicones such as polydimethylsilicone, and curable silicones such as aminosilicones, phenylsilicones and hydroxysilicones. The word "silicone" as used herein preferably refers to emulsified silicones, including those that are commercially available and those that are emulsified in the composition, unless otherwise described.

The silicones that are preferred in the composition of the present invention is polyalkyl and/or phenylsilicones silicone fluids and gums with the following structure:

$$A\text{-}Si(R_2)—O—[Si(R_2)—O—]_q—Si(R_2)\text{-}A$$

The alkyl groups substituted on the siloxane chain (R) or at the ends of the siloxane chains (A) can have any structure as long as the resulting silicones remain fluid at room temperature.

Each R group preferably can be alkyl, aryl, hydroxy, or hydroxyalkyl group, and mixtures thereof, more preferably, each R is methyl, ethyl, propyl or phenyl group, most preferably R is methyl. Each A group which blocks the ends of the silicone chain can be hydrogen, methyl, methoxy, ethoxy, hydroxy, propoxy, and aryloxy group, preferably methyl. Suitable A groups include hydrogen, methyl, methoxy, ethoxy, hydroxy, and propoxy. q is preferably an integer from about 7 to about 8,000. The preferred silicones are polydimethyl siloxanes; more preferred silicones are polydimethyl siloxanes having a viscosity of from about 50 to about 5,000 centistokes at 25° C. Suitable examples include silicones offered by Dow Corning Corporation and General Electric Company.

Other useful silicone materials, but less preferred than polydimethyl siloxanes, include materials of the formula:

$$HO—[Si(CH_3)_2—O]_x—\{Si(OH)[(CH_2)_3—NH—(CH_2)_2—NH_2]O\}_y—H$$

wherein x and y are integers which depend on the molecular weight of the silicone, preferably having a viscosity of from about 10,000 cst to about 500,000 cst at 25° C. This material is also known as "amodimethicone". These aminofunctional silicones are highly substantive to fabrics.

When the composition of this invention is to be dispensed from a spray dispenser in a consumer household setting, the noncurable silicones such as polydimethylsilicone, are preferred. Curable and/or reactive silicones such as aminofunctional silicones and silicones with reactive groups such as Si—OH, Si—H, silanes, and the like, are not preferred in this situation, because the portion of the composition that is sprayed but misses the garment, and falls instead on flooring surfaces, such as rug, carpet, concrete floor, tiled floor, linoleum floor, bathtub floor, can leave a silicone layer that is cured and/or bonded to the flooring surfaces. Such silicones that are bonded to surfaces are difficult to be removed from the flooring surfaces. Flooring surfaces thus become slippery and can present a safety hazard to the household members. The curable and reactive silicones can be used in compositions specifically designed for use in enclosed areas such as in a dewrinkling cabinet. Many types of aminofunctional silicones also cause fabric yellowing. Thus, the silicones that cause fabric discoloration are also not preferred.

Another silicone material which can be used, but is less preferred than polydimethyl siloxanes, has the formula:

$$(CH_3)_3Si—[O—Si(CH_3)_2]_n—\{OSi(CH_3)[(CH_2)_3—NH—(CH_2)_2—NH_2]\}_m—OSi(CH_3)_3$$

wherein the sum of n+m is a number from 2 to about 1,000. The preferred silicones of this type are those which do not cause fabric discoloration.

The fabric color care silicones can also impart a lubricating property, and are useful in the composition to provide fabric wrinkle control benefit A preferred class of silicone derivatives that are useful in the present invention are the silicone copolyols. Nonlimiting examples of silicone copolyols are the polyalkylene oxide polysiloxanes having a dimethyl polysiloxane hydrophobic moiety and one or more hydrophilic polyalkylene side chains, and having the general formula:

$$R^1—(CH_3)_2SiO—[(CH_3)_2SiO]_a—[(CH_3)(R^1)SiO]_b—Si(CH_3)_2—R^1$$

wherein a+b are from about 1 to about 50, preferably from about 3 to about 30, more preferably from about 10 to about 25, and each $R^1$ is the same or different and is selected from the group consisting of methyl and a poly(ethyleneoxide/propyleneoxide) copolymer group having the general formula:

$$—(CH_2)_nO(C_2H_4O)_c(C_3H_6O)_dR^2$$

with at least one R being a poly(ethyleneoxy/propyleneoxy) copolymer group, and wherein n is 3 or 4, preferably 3; total c (for all polyalkyleneoxy side groups) has a value of from 1 to about 100, preferably from about 6 to about 100; total d is from 0 to about 14, preferably from 0 to about 3; and more preferably d is 0; total c+d has a value of from about 5 to about 150, preferably from about 9 to about 100 and each $R^2$ is the same or different and is selected from the group consisting of hydrogen, an alkyl having 1 to 4 carbon atoms, and an acetyl group, preferably hydrogen and methyl group. Each polyalkylene oxide polysiloxane has at least one $R^1$ group being a poly(ethyleneoxide/propyleneoxide) copolymer group.

Nonlimiting examples of this type of silicone copolyols are the Silwet® surfactants which are available from Witco Corporation. Representative Silwet surfactants which contain only ethyleneoxy ($C_2H_4O$) groups are as follows.

| Name | Average MW | Average a + b | Average total c |
|---|---|---|---|
| L-7607 | 1,000 | 2 | 17 |
| L-7605 | 6,000 | 20 | 99 |
| L-7604 | 4,000 | 21 | 53 |
| L-7600 | 4,000 | 11 | 68 |
| L-7657 | 5,000 | 20 | 76 |

-continued

| Name | Average MW | Average a + b | Average total c |
|---|---|---|---|
| L-7602 | 3,000 | 20 | 29 |
| L-7622 | 10,000 | 88 | 75 |

Nonlimiting examples of surfactants which contain both ethyleneoxy ($C_2H_4O$) and propyleneoxy ($C_3H_6O$) groups are as follows.

| Name | Average MW | EO/PO ratio |
|---|---|---|
| Silwet L-720 | 12,000 | 50/50 |
| Silwet L-7001 | 20,000 | 40/60 |
| Silwet L-7002 | 8,000 | 50/50 |
| Silwet L-7210 | 13,000 | 20/80 |
| Silwet L-7200 | 19,000 | 75/25 |
| Silwet L-7220 | 17,000 | 20/80 |

The molecular weight of the polyalkyleneoxy group ($R^1$) is less than or equal to about 10,000. Preferably, the molecular weight of the polyalkyleneoxy group is less than or equal to about 8,000, and most preferably ranges from about 300 to about 5,000. Thus, the values of c and d can be those numbers which provide molecular weights within these ranges. However, the number of ethyleneoxy units (—$C_2H_4O$) in the polyether chain ($R^1$) must be sufficient to render the polyalkylene oxide polysiloxane water dispersible or water soluble. If propyleneoxy groups are present in the polyalkylenoxy chain, they can be distributed randomly in the chain or exist as blocks. Surfactants which contain only propyleneoxy groups without ethyleneoxy groups are less preferred.

Other useful silicone derivatives are those having a hydrophobic moiety and hydrophilic ionic groups, including, e.g., anionic, cationic, and amphoteric groups. Nonlimiting examples of anionic silicone surfactants are silicone sulfosuccinates, silicone sulfates, silicone phosphates, silicone carboxylates, and mixtures thereof, as disclosed respectively in U.S. Pat. Nos. 4,717,498, 4,960,845, 5,149,765, and 5,296,434. Nonlimiting examples of cationic silicone surfactants are silicone alkyl quats (quaternary ammoniums), silicone amido quats, silicone imidazoline quats, and mixtures thereof, as disclosed respectively in U.S. Pat. Nos. 5,098,979, 5,135,294, and 5,196,499. Nonlimiting examples of amphoteric silicone surfactants are silicone betaines, silicone amino proprionates, silicone phosphobetaines, and mixtures thereof, as disclosed respectively in U.S. Pat. Nos. 4,654,161, 5,073,619, and 5,237,035. All of these patents are incorporated herein by reference.

A special type of synthetic fabric color care polymer useful in the present invention comprises graft and block copolymers of silicone with moieties containing hydrophilic and/or hydrophobic monomers described hereinbefore. The silicone-containing copolymers in the spray composition of the present invention provide color rejuvenation, and in addition, other fabric care benefits such as shape retention, body, and/or good, soft fabric feel. Preferred silicone-containing copolymers contain hydrophobic monomers and hydrophilic monomers which comprise unsaturated organic mono-carboxylic and/or polycarboxylic acid monomers, such as acrylic acid, methacrylic acid, crotonic acid, maleic acid and its half esters, itaconic acid; and salts thereof; and mixtures thereof; and optionally other hydrophilic monomers.

Surfactant Capable of Forming a Bilayer Structure

Surfactants capable of forming a bilayer structure are those that can form a vesicle or liposome. Suitable surfactants include phospholipids such as phosphatidyl choline, phosphatidylethanolamine, phosphatidylinositol, lecithin, cephalin, plasmalogen, and mixtures thereof, glycolipids such as cerbroside, sorbitan esters of long chain ($C_{16}$–$C_{18}$) fatty acids, lactic acid esters of long chain ($C_{16}$–$C_{18}$) fatty acid monoglycerides (e.g., Lactem), diacetyl tartaric acid esters of long chain ($C_{16}$–$C_{18}$) fatty acid monoglycerides (e.g., Panodan FDPK), and mixtures thereof.

A preferred class of surfactants capable of forming a bilayer structure are the fabric softening actives. These materials are traditionally used in rinse-added and dryer-added fabric softener compositions. In the current invention, the fabric softening actives are preferably used in fabric color care compositions that are applied directly to the worn, faded fabrics, such as by spraying, soaking, dipping, or padding, preferably spraying, which are very efficient. The treatment using said fabric softening actives in the rinse for fabric color restoration benefit is less efficient, and requires a high level of fabric softening active, and thus is less preferred. The method of using a dryer-added fabric softener sheet in the dryer is also not preferred, because it can provide a patchy, non-uniform coverage of the fabric visible surface, resulting in a poor fabric appearance.

Any fabric softening active, including quaternary and non-quaternary softening actives, with saturated, partially saturated, unsaturated an/or highly unsaturated, with straight, linear alkyl chains and/or branched alkyl groups, can be used in the fabric color care composition of the present invention, to be applied directly to the worn, faded fabric, preferably via a spraying mechanism. Biodegradable fabric softening actives are preferred.

A preferred fabric color care composition herein uses fabric softening active with highly unsaturated and/or branched hydrophobic chains, preferably biodegradable, selected from the highly unsaturated and/or branched fabric softening actives, and mixtures thereof.

Preferred fabric softening actives of the invention comprise a majority of compounds as follows:

Diester Quaternary Ammonium Fabric Softening Active Compound (DEQA)

(1) The first type of DEQA preferably comprises, as the principal active, compounds of the formula $$\{R_{4-m}—N^+—[(CH_2)_n—Y—R^1]_m\}A^-$$

wherein each R substituent is either hydrogen, a short chain $C_1$–$C_6$, preferably $C_1$–$C_3$ alkyl or hydroxyalkyl group, e.g., methyl (most preferred), ethyl, propyl, hydroxyethyl, and the like, poly ($C_{2-3}$alkoxy) preferably polyethoxy group, benzyl, or mixtures thereof; each m is 2 or 3; each n is from 1 to about 4; each Y is —O—(O)C—, —C(O)—O—, —NR—C(O)—, or —C(O)—NR—; the sum of carbons in each $R^1$, plus one when Y is —O—(O)C— or —NR—C(O)—, is $C_{12}$–$C_{22}$, preferably $C_{14}$–$C_{20}$, with each $R^1$ being a hydrocarbyl, or substituted hydrocarbyl group, and $A^-$ can be any softener-compatible anion, preferably, chloride, bromide, methylsulfate, ethylsulfate, sulfate, and nitrate, more preferably chloride or methyl sulfate. (As used herein, the "percent of softening active" containing a given $R^1$ group is based upon taking a percentage of the total active based upon the percentage that the given $R^1$ group is, of the total $R^1$ groups present.)

(2) A second type of DEQA active has the general formula:

$$[R_3N^+CH_2CH(YR^1)(CH_2YR^1)]A^-$$

wherein each Y, R, $R^1$, and $A^-$ have the same meanings as before. Such compounds include those having the formula:

$$[CH_3]_3N^{(+)}[CH_2CH(CH_2O(O)CR^1)O(O)CR^1]Cl^{(-)}$$

where each R is a methyl or ethyl group and preferably each $R^1$ is in the range of $C_{15}$ to $C_{19}$.

These types of agents and general methods of making them are disclosed in U.S. Pat. No. 4,137,180, Naik et al., issued Jan. 30, 1979, which is incorporated herein by reference. An example of a preferred DEQA of formula (2) is the "propyl" ester quaternary ammonium fabric softening active having the formula 1,2-di(acyloxy)-3-trimethylammoniopropane chloride, where the acyl is the same as that of $FA^1$ mixture disclosed hereinafter.

These biodegradable quaternary ammonium fabric softening compounds preferably contain the group $C(O)R^1$ which is preferably derived from partially hydrogenated fatty acids from natural sources, e.g., derived from animal fat, such as tallow fatty acids. More preferred are unsaturated fatty acids, e.g., oleic acid, and polyunsaturated fatty acids, such as those derived from vegetable oils, such as, canola oil, safflower oil, peanut oil, sunflower oil, corn oil, soybean oil, tall oil, rice bran oil, etc. Non-limiting examples of fatty acids (FA) are listed in U.S. Pat. No. 5,759,990 at column 4, lines 45–66. Fabric softening actives containing unsaturated and polyunsaturated fatty acids are preferred in formulating the fabric color care compositions of the present invention.

Iodine Value (referred to as "IV" herein) is used to define the level of unsaturation of a fatty acid. As used herein, Iodine Value of the "parent" fatty acid, or "corresponding" fatty acid that the $R^1$ group is derived from, is also used to define the level of unsaturation of a fabric softening active. The IV of the parent fatty acids of these $R^1$ group is from about 0 to about 140, more preferably from about 40 to about 130, on the average. For concentrate, clear compositions, The IV is preferably from about 70 to about 140, more preferably from about 80 to about 130, and even more preferably from about 90 to about 115, on the average.

It is preferred that at least a majority of the fatty acyl groups are unsaturated, e.g., from about 50% to 100%, preferably from about 55% to about 100%, more preferably from about 60% to about 100%.

Another DEQA softening active that is suitable for the formulation of the fabric color care compositions of the present invention, has the above formula (1) wherein one R group is a $C_{1-4}$ hydroxy alkyl group, or polyalkoxy group, preferably hydroxy alkyl, more preferably hydroxyethyl, group. An example of such a hydroxyethyl ester active is di(acyloxyethyl)(2-hydroxyethyl)methyl ammonium methyl sulfate, where the acyl is derived from the fatty acids described hereinbefore, e.g., oleic acid and other highly unsaturated fatty acids.

Polyquaternary Ammonium Softening Actives. Fabric softening actives carrying more than one positive quaternary ammonium charge are also useful in the fabric color care compositions of the present invention. An example of this type of softening active is that having the formula:

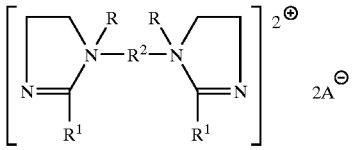

wherein each R is H or a short chain $C_1$–$C_6$, preferably $C_1$–$C_3$ alkyl or hydroxyalkyl group, e.g., methyl (most preferred), ethyl, propyl, hydroxyethyl, and the like, benzyl, or $(R^2\ O)_{2\text{-}4}H$; each $R^1$ is a $C_6$–$C_{22}$, preferably $C_{14}$–$C_{20}$ hydrocarbyl, or substituted hydrocarbyl substituent, preferably $C_{10}$–$C_{20}$ alkyl or alkenyl (unsaturated alkyl, including polyunsaturated alkyl, also referred to sometimes as "alkylene"), most preferably $C_{12}$–$C_{18}$ alkyl or alkenyl; each $R^2$ is a $C_{1\text{-}6}$ alkylene group, preferably an ethylene group; and $A^-$ are defined as below. Fabric softening actives having the following formula:

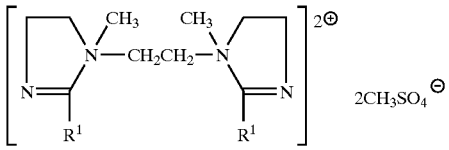

wherein $R^1$ is derived from oleic acid is available from Witco Company.

Softening active having the formula:

$$R_{4\text{-}m}—N^{(+)}—R^1{}_mA^-$$

wherein each m is 2 or 3, each $R^1$ is a $C_6$–$C_{22}$, preferably $C_{14}$–$C_{20}$, but no more than one being less than about $C_{12}$ and then the other is at least about 16, hydrocarbyl, or substituted hydrocarbyl substituent, preferably $C_{10}$–$C_{20}$ alkyl or alkenyl, most preferably $C_{12}$–$C_{18}$ alkyl or alkenyl, and where the Iodine Value of a fatty acid containing this $R^1$ group is from 0 to about 140, more preferably from about 40 to about 130; with a cis/trans ratio of from about 1:1 to about 50:1, the minimum being 1:1, preferably from about 2:1 to about 40:1, more preferably from about 3:1 to about 30:1, and even more preferably from about 4:1 to about 20:1; each $R^1$ can also be a branched chain $C_{14}$–$C_{22}$ alkyl group, preferably a branched chain $C_{16}$–$C_{18}$ group; each R is H or a short chain $C_1$–$C_6$, preferably $C_1$–$C_3$ alkyl or hydroxyalkyl group, e.g., methyl (most preferred), ethyl, propyl, hydroxyethyl, and the like, benzyl, or $(R^2\ O)_{2\text{-}4}H$; and $A^-$ is a softening active compatible anion, preferably, chloride, bromide, methylsulfate, ethylsulfate, sulfate, and nitrate, more preferably chloride and methyl sulfate.

Other fabric softening actives that can be used herein are disclosed, at least generically for the basic structures, in U.S. Pat. No. 3,408,361, Mannheimer, issued Oct. 29, 1968; U.S. Pat. No. 4,709,045; Kubo et al., issued Nov. 24, 1987; U.S. Pat. No. 4,233,451, Pracht et al., issued Nov. 11, 1980; U.S. Pat. No. 4,127,489, Pracht et al., issued Nov. 28, 1979; U.S. Pat. No. 3,689,424, Berg et al., issued Sep. 5, 1972; U.S. Pat. No. 4,128,485, Baumann et al., issued Dec. 5, 1978; U.S. Pat. No. 4,161,604, Elster et al., issued Jul. 17, 1979; U.S. Pat. No. 4,189,593, Wechsler et al., issued Feb. 19, 1980; U.S. Pat. No. 4,339,391, Hoffman et al., issued Jul. 13, 1982 U.S. Pat. No. 3,861,870, Edwards and Diehl; U.S. Pat. No. 4,308,151, Cambre; U.S. Pat. No. 3,886,075, Bernardino; U.S. Pat. No. 4,233,164, Davis; U.S. Pat. No. 4,401,578, Verbruggen; U.S. Pat. No. 3,974,076, Wiersema and Rieke; U.S. Pat. No. 4,237,016, Rudkin, Clint, and Young; U.S. Pat. No. 4,885,102, Yamamura et al., issued Dec. 5, 1989; U.S. Pat. No. 4,937,008, Yamamura et al., issued Jun. 26, 1990; and U.S. Pat. No. 5,133,885, Contor et al., issued Jul. 28, 1992; Case 4768C, Trinh et al.; and European patent applications 91/336,267, Rutzen et a.l. and 91/423,894, Contor et al. and International Patent WO 91/01295, Trius et al., published Feb. 7, 1991, all of said patents and applications being incorporated herein by reference.

Other useful fabric softening actives are disclosed in U.S. Pat. No. 4,661,269, issued Apr. 28, 1987, to T. Trinh, E. H. Wahl, D. M. Swartley and R. L. Hemingway. Biodegradable ester and/or amide linked fabric softening actives are disclosed, e.g., in U.S. Pat. No. 5,545,340, issued Aug. 13, 1996, to Wahl et al. Biodegradable unsaturated ester and/or amide linked fabric softening actives in concentrated clear compositions are disclosed in U.S. Pat. No. 5,759,990, issued Jun. 2, 1998 in the names of Wahl, Tordil, Trinh, Carr, Keys, and Meyer, and in U.S. Pat. No. 5,747,443, issued May 5, 1998 in the names of Wahl, Trinh, Gosselink, Letton, and Sivik. All said patents are incorporated herein by reference.

Optional Ingredients

The fabric care composition of the present invention can optionally contain surfactant, perfume, brightener, odor-controlling agent, antimicrobial active and/or preservative, antistatic agent, antioxidant, insect and moth repelling agent, and mixtures thereof. The total level of optional ingredients is low, preferably less than about 5%, more preferably less than about 3%, and even more preferably less than about 2%, by weight of the usage composition. These optional ingredients exclude the other ingredients specifically mentioned hereinbefore.

Surfactant

Surfactant is an optional but highly preferred ingredient of the present invention. Surfactant is especially useful in the composition to facilitate the dispersion and/or solubilization of color improvement agents such as silicones and/or perfume. Such surfactant is preferably included when the composition is used in a spray dispenser in order to enhance the spray characteristics of the composition and allow the composition, including the fabric color care active, to distribute more evenly, and to prevent clogging of the spray apparatus. The spreading of the composition can also allow it to dry faster, so that the treated material is ready to use sooner. For concentrated compositions, the surfactant facilitates the dispersion of many actives such as antimicrobial actives and perfumes in the concentrated aqueous compositions. Suitable surfactant useful in the present invention is nonionic surfactant, anionic surfactant, cationic surfactant, amphoteric surfactant, and mixtures thereof.

When surfactant is used in the composition of the present invention, it is added at an effective amount to provide one, or more of the benefits described herein, typically from about 0.01% to about 5%, preferably from about 0.05% to about 3%, more preferably from about 0.1% to about 2%, and even more preferably, from about 0.2% to about 1%, by weight of the usage composition.

A preferred type of surfactant is ethoxylated surfactant, such as addition products of ethylene oxide with fatty alcohols, fatty acids, fatty amines, etc. Optionally, addition products of mixtures of ethylene oxide and propylene oxide with fatty alcohols, fatty acids, fatty amines can be used. The ethoxylated surfactant includes compounds having the general formula:

$$R^8\text{-}Z\text{-}(CH_2CH_2O)_sB$$

wherein $R^8$ is an alkyl group or an alkyl aryl group, selected from the group consisting of primary, secondary and branched chain alkyl hydrocarbyl groups, primary, secondary and branched chain alkenyl hydrocarbyl groups, and/or primary, secondary and branched chain alkyl- and alkenyl-substituted phenolic hydrocarbyl groups having from about 6 to about 20 carbon atoms, preferably from about 8 to about 18, more preferably from about 10 to about 15 carbon atoms; s is an integer from about 2 to about 45, preferably from about 2 to about 20, more preferably from about 2 to about 15; B is a hydrogen, a carboxylate group, or a sulfate group; and linking group Z is —O—, —C(O)O—, —C(O)N(R)—, or —C(O)N(R)—, and mixtures thereof, in which R, when present, is $R^8$ or hydrogen.

The nonionic surfactants herein are characterized by an HLB (hydrophilic-lipophilic balance) of from 5 to 20, preferably from 6 to 15.

Nonlimiting examples of preferred ethoxylated surfactant are:

- straight-chain, primary alcohol ethoxylates, with $R^8$ being $C_8$–$C_{18}$ alkyl and/or alkenyl group, more preferably $C_{10}$–$C_{14}$, and s being from about 2 to about 8, preferably from about 2 to about 6;
- straight-chain, secondary alcohol ethoxylates, with $R^8$ being $C_8$–$C_{18}$ alkyl and/or alkenyl, e.g., 3-hexadecyl, 2-octadecyl, 4-eicosanyl, and 5-eicosanyl, and s being from about 2 to about 10;
- alkyl phenol ethoxylates wherein the alkyl phenols having an alkyl or alkenyl group containing from 3 to 20 carbon atoms in a primary, secondary or branched chain configuration, preferably from 6 to 12 carbon atoms, and s is from about 2 to about 12, preferably from about 2 to about 8;
- branched chain alcohol ethoxylates, wherein branched chain primary and secondary alcohols (or Guerbet alcohols) which are available, e.g., from the well-known "OXO" process or modification thereof are ethoxylated.

Especially preferred are alkyl ethoxylate surfactants with each $R^8$ being $C_8$–$C_{16}$ straight chain and/or branch chain alkyl and the number of ethyleneoxy groups s being from about 2 to about 6, preferably from about 2 to about 4, more preferably with $R^8$ being $C_8$–$C_{15}$ alkyl and s being from about 2.25 to about 3.5. These nonionic surfactants are characterized by an HLB of from 6 to about 11, preferably from about 6.5 to about 9.5, and more preferably from about 7 to about 9. Nonlimiting examples of commercially available preferred surfactants are Neodol 91-2.5 ($C_9$–$C_{10}$, s=2.7, HLB=8.5), Neodol 23-3 ($C_{12}$–$C_{13}$, s=2.9, HLB=7.9) and Neodol 25-3 ($C_{12}$–$C_{15}$, s=2.8, HLB=7.5). It is found, very surprisingly, that these preferred surfactants which are themselves not very water soluble (0.1% aqueous solutions of these surfactants are not clear), can at low levels, effectively dissolve and/or disperse shape retention polymers such as copolymers containing acrylic acid and tert-butyl acrylate and silicone-containing copolymers into clear compositions, even without the presence of a low molecular weight alcohol.

Also preferred is a nonionic surfactant selected from the group consisting of fatty acid ($C_{12-18}$) esters of ethoxylated ($EO_{5-100}$) sorbitans. More preferably said surfactant is selected from the group consisting of mixtures of laurate esters of sorbitol and sorbitol anhydrides; mixtures of stearate esters of sorbitol and sorbitol anhydrides; and mixtures of oleate esters of sorbitol and sorbitol anhydrides. Even more preferably said surfactant is selected from the group consisting of Polysorbate 20, which is a mixture of laurate esters of sorbitol and sorbitol anhydrides consisting predominantly of the monoester, condensed with about 20 moles of ethylene oxide; Polysorbate 60 which is a mixture of stearate esters of sorbitol and sorbitol anhydride, consisting predominantly of the monoester, condensed with about 20 moles of ethylene oxide; Polysorbate 80 which is a mixture of oleate esters of sorbitol and sorbitol anhydrides, consisting predominantly of the monoester, condensed with about 20 moles of ethylene oxide; and mixtures thereof. Most preferably, said surfactant is Polysorbate 60.

Other examples of preferred ethoxylated surfactant include carboxylated alcohol ethoxylate, also known as ether carboxylate, with $R^8$ having from about 12 to about 16 carbon atoms and s being from about 5 to about 13; ethoxylated quaternary ammonium surfactants, such as PEG-5 cocomonium methosulfate, PEG-15 cocomonium chloride, PEG-15 oleammonium chloride and bis (polyethoxyethanol)tallow ammonium chloride.

Other suitable nonionic ethoxylated surfactants are ethoxylated alkyl amines derived from the condensation of ethylene oxide with hydrophobic alkyl amines, with $R^8$ having from about 8 to about 22 carbon atoms and s being from about 3 to about 30.

Also suitable nonionic ethoxylated surfactants for use herein are alkylpolysaccharides which are disclosed in U.S. Pat. No. 4,565,647, Llenado, issued Jan. 21, 1986, incorporated herein by reference, having a hydrophobic group containing from about 8 to about 30 carbon atoms, preferably from about 10 to about 16 carbon atoms and a polysaccharide, e.g., a polyglycoside, hydrophilic group containing from about 1.3 to about 10, preferably from about 1.3 to about 3, most preferably from about 1.3 to about 2.7 saccharide units. Any reducing saccharide containing 5 or 6 carbon atoms can be used, e.g., glucose, galactose and galactosyl moieties can be substituted for the glucosyl moieties. The intersaccharide bonds can be, e.g., between the one position of the additional saccharide units and the 2-, 3-, 4-, and/or 6-positions on the preceding saccharide units. The preferred alkylpolyglycosides have the formula $$R^2O(C_nH_{2n}O)t(\text{glycosyl})_x$$

wherein $R^2$ is selected from the group consisting of alkyl, alkylphenyl, hydroxyalkyl, hydroxyalkylphenyl, and mixtures thereof in which the alkyl groups contain from 10 to 18, preferably from 12 to 14, carbon atoms; n is 2 or 3, preferably from about 1.3 to about 3, most preferably from about 1.3 to about 2.7. The glycosyl is preferably derived from glucose.

Odor Control Agent

The agents for odor control are of the type disclosed in U.S. Pat. Nos. 5,534,165; 5,578,563; 5,663,134; 5,668,097; 5,670,475; and 5,714,137, Trinh et al. issued Jul. 9, 1996; Nov. 26, 1996; Sep. 2, 1997; Sep. 16, 1997; Sep. 23, 1997; and Feb. 3, 1998 respectively, all of said patents being incorporated herein by reference. Fabric care compositions of the present invention can contain several different optional odor control agents, preferably cyclodextrins, water soluble zinc salts, water soluble copper salts, and mixtures thereof.

(a). Cyclodextrin

As used herein, the term "cyclodextrin" includes any of the known cyclodextrins such as unsubstituted cyclodextrins containing from six to twelve glucose units, especially, alpha-cyclodextrin, beta-cyclodextrin, gamma-cyclodextrin and/or their derivatives and/or mixtures thereof. The alpha-cyclodextrin consists of six glucose units, the beta-cyclodextrin consists of seven glucose units, and the gamma-cyclodextrin consists of eight glucose units arranged in donut-shaped rings. The specific coupling and conformation of the glucose units give the cyclodextrins a rigid, conical molecular structures with hollow interiors of specific volumes. The "lining" of each internal cavity is formed by hydrogen atoms and glycosidic bridging oxygen atoms; therefore, this surface is fairly hydrophobic. The unique shape and physical-chemical properties of the cavity enable the cyclodextrin molecules to absorb (form inclusion complexes with) organic molecules or parts of organic molecules which can fit into the cavity. Many odorous molecules can fit into the cavity including many malodorous molecules and perfume molecules. Therefore, cyclodextrins, and especially mixtures of cyclodextrins with different size cavities, can be used to control odors caused by a broad spectrum of organic odoriferous materials, which may, or may not, contain reactive functional groups. The complexation between cyclodextrin and odorous molecules occurs rapidly in the presence of water. However, the extent of the complex formation also depends on the polarity of the absorbed molecules. In an aqueous solution, strongly hydrophilic molecules (those which are highly water-soluble) are only partially absorbed, if at all. Therefore, cyclodextrin does not complex effectively with some very low molecular weight organic amines and acids when they are present at low levels on wet fabrics. As the water is being removed however, e.g., the fabric is being dried off, some low molecular weight organic amines and acids have more affinity and will complex with the cyclodextrins more readily.

The cavities within the cyclodextrin in the solution of the present invention should remain essentially unfilled (the cyclodextrin remains uncomplexed) while in solution, in order to allow the cyclodextrin to absorb various odor molecules when the solution is applied to a surface. Non-derivatised (normal) beta-cyclodextrin can be present at a level up to its solubility limit of about 1.85% (about 1.85 g in 100 grams of water) at room temperature. Beta-cyclodextrin is not preferred in compositions which call for a level of cyclodextrin higher than its water solubility limit. Non-derivatised beta-cyclodextrin is generally not preferred when the composition contains surfactant since it affects the surface activity of most of the preferred surfactants that are compatible with the derivatised cyclodextrins.

Preferably, the odor absorbing solution of the present invention is clear. The term "clear" as defined herein means transparent or translucent, preferably transparent, as in "water clear," when observed through a layer having a thickness of less than about 10 cm.

Preferably, the cyclodextrins used in the present invention are highly water-soluble such as, alpha-cyclodextrin and/or derivatives thereof, gamma-cyclodextrin and/or derivatives thereof, derivatised beta-cyclodextrins, and/or mixtures thereof. The derivatives of cyclodextrin consist mainly of molecules wherein some of the OH groups are converted to OR groups. Cyclodextrin derivatives include, e.g., those with short chain alkyl groups such as methylated cyclodextrins, and ethylated cyclodextrins, wherein R is a methyl or an ethyl group; those with hydroxyalkyl substituted groups, such as hydroxypropyl cyclodextrins and/or hydroxyethyl cyclodextrins, wherein R is a $—CH_2—CH(OH)—CH_3$ or a $—CH_2CH_2—OH$ group; branched cyclodextrins such as maltose-bonded cyclodextrins; cationic cyclodextrins such as those containing 2-hydroxy-3-(dimethylamino)propyl ether, wherein R is $CH_2—CH(OH)—CH_2—N(CH_3)_2$ which is cationic at low pH; quaternary ammonium, e.g., 2-hydroxy-3-(trimethylammonio) propyl ether chloride groups, wherein R is $CH_2—CH(OH)—CH_2—N^+(CH_3)_3Cl^-$; anionic cyclodextrins such as carboxymethyl cyclodextrins, cyclodextrin sulfates, and cyclodextrin succinylates; amphoteric cyclodextrins such as carboxymethyl/quaternary ammonium cyclodextrins; cyclodextrins wherein at least one glucopyranose unit has a 3-6-anhydro-cyclomalto structure, e.g., the mono-3-6-anhydrocyclodextrins, as disclosed in "Optimal Performances with Minimal Chemical Modification of Cyclodextrins", F. Diedaini-Pilard and B. Perly, The 7th International Cyclodextrin Symposium Abstracts, April 1994, p. 49, said references being incorporated herein by reference; and mixtures thereof. Other cyclodextrin derivatives are disclosed in U.S. Pat. No. 3,426,011, Parmerter et al., issued Feb. 4, 1969; U.S. Pat. Nos. 3,453,257; 3,453,258; 3,453,259; and 3,453,260, all in the names of Parmerter et al., and all issued Jul. 1, 1969; U.S. Pat. No. 3,459,731, Gramera et al., issued Aug. 5, 1969; U.S. Pat. No. 3,553,191, Parmerter et al., issued Jan. 5, 1971; U.S. Pat. No. 3,565,887, Parmerter et al., issued Feb. 23, 1971; U.S. Pat. No. 4,535,152, Szejtli et al., issued Aug. 13, 1985; U.S. Pat. No. 4,616,008, Hirai et al., issued Oct. 7, 1986; U.S. Pat. No. 4,678,598, Ogino et al., issued Jul. 7, 1987; U.S. Pat. No. 4,638,058, Brandt et al., issued Jan. 20, 1987; and U.S. Pat. No. 4,746,734, Tsuchiyama et al., issued May 24, 1988; all of said patents being incorporated herein by reference.

Highly water-soluble cyclodextrins are those having water solubility of at least about 10 g in 100 ml of water at room temperature, preferably at least about 20 g in 100 ml of water, more preferably at least about 25 g in 100 ml of water at room temperature. The availability of solubilized, uncomplexed cyclodextrins is essential for effective and efficient odor control performance. Solubilized, water-soluble cyclodextrin can exhibit more efficient odor control performance than non-water-soluble cyclodextrin when deposited onto surfaces, especially fabric.

Examples of preferred water-soluble cyclodextrin derivatives suitable for use herein are hydroxypropyl alpha-cyclodextrin, methylated alpha-cyclodextrin, methylated beta-cyclodextrin, hydroxyethyl beta-cyclodextrin, and hydroxypropyl beta-cyclodextrin. Hydroxyalkyl cyclodextrin derivatives preferably have a degree of substitution of from about 1 to about 14, more preferably from about 1.5 to about 7, wherein the total number of OR groups per cyclodextrin is defined as the degree of substitution. Methylated cyclodextrin derivatives typically have a degree of substitution of from about 1 to about 18, preferably from about 3 to about 16. A known methylated beta-cyclodextrin is heptakis-2,6-di-O-methyl-β-cyclodextrin, commonly known as DIMEB, in which each glucose unit has about 2 methyl groups with a degree of substitution of about 14. A preferred, more commercially available, methylated beta-cyclodextrin is a randomly methylated beta-cyclodextrin, commonly known as RAMEB, having different degrees of substitution, normally of about 12.6. RAMEB is more preferred than DIMEB, since DIMEB affects the surface activity of the preferred surfactants more than RAMEB. The preferred cyclodextrins are available, e.g., from Cerestar USA, Inc. and Wacker Chemicals (USA), Inc.

It is also preferable to use a mixture of cyclodextrins. Such mixtures absorb odors more broadly by complexing with a wider range of odoriferous molecules having a wider range of molecular sizes. Preferably at least a portion of the cyclodextrins is alpha-cyclodextrin and its derivatives thereof, gamma-cyclodextrin and its derivatives thereof, and/or derivatised beta-cyclodextrin, more preferably a mixture of alpha-cyclodextrin, or an alpha-cyclodextrin derivative, and derivatised beta-cyclodextrin, even more preferably a mixture of derivatised alpha-cyclodextrin and derivatised beta-cyclodextrin, most preferably a mixture of hydroxypropyl alpha-cyclodextrin and hydroxypropyl beta-cyclodextrin, and/or a mixture of methylated alpha-cyclodextrin and methylated beta-cyclodextrin.

For controlling odor on fabrics, the composition is preferably used as a spray. It is preferable that the usage compositions of the present invention contain low levels of cyclodextrin so that a visible stain does not appear on the fabric at normal usage levels. Preferably, the solution used to treat the surface under usage conditions is virtually not discernible when dry. Typical levels of cyclodextrin in usage compositions for usage conditions are from about 0.01% to about 5%, preferably from about 0.1% to about 4%, more preferably from about 0.5% to about 2% by weight of the composition. Compositions with higher concentrations can leave unacceptable visible stains on fabrics as the solution evaporates off of the fabric. This is especially a problem on thin, colored, synthetic fabrics. In order to avoid or minimize the occurrence of fabric staining, it is preferable that the fabric be treated at a level of less than about 5 mg of cyclodextrin per gram of fabric, more preferably less than about 2 mg of cyclodextrin per gram of fabric. The presence of the surfactant can improve appearance by minimizing localized spotting.

When the optional cyclodextrin is present in the composition, the polymer active in the composition of the present invention should be cyclodextrin-compatible, that is it should not substantially form complexes with cyclodextrin so as to diminish performance of the cyclodextrin and/or the polymer. Complex formation affects both the ability of the cyclodextrin to absorb odors and the ability of the polymer to impart color renewal and/or shape retention to fabric. In this case, the monomers having pendant groups that can complex with cyclodextrin are not preferred because they can form complexes with cyclodextrin. Examples of such monomers are acrylic or methacrylic acid esters of $C_7$–$C_{18}$ alcohols, such as neodecanol, 3-heptanol, benzyl alcohol, 2-octanol, 6-methyl-1-heptanol, 2-ethyl-1-hexanol, 3,5-dimethyl-1-hexanol, 3,5,5-trimethyl-1-hexanol, and 1-decanol; aromatic vinyls, such as styrene; t-butylstyrene; vinyl toluene; and the like.

Low Molecular Weight Polyols

Low molecular weight polyols with relatively high boiling points, as compared to water, such as ethylene glycol, propylene glycol and/or glycerol are preferred optional ingredients for improving odor control performance of the composition of the present invention when cyclodextrin is present. Not to be bound by theory, it is believed that the incorporation of a small amount of low molecular weight glycols into the composition of the present invention enhances the formation of the cyclodextrin inclusion complexes as the fabric dries.

It is believed that the polyols' ability to remain on the fabric for a longer period of time than water, as the fabric dries allows it to form ternary complexes with the cyclodextrin and some malodorous molecules. The addition of the glycols is believed to fill up void space in the cyclodextrin cavity that is unable to be filled by some malodor molecules of relatively smaller sizes. Preferably the glycol used is glycerin, ethylene glycol, propylene glycol, diethylene glycol, dipropylene glycol or mixtures thereof, more preferably ethylene glycol and/or propylene glycol. Cyclodextrins prepared by processes that result in a level of such polyols are highly desirable, since they can be used without removal of the polyols.

Some polyols, e.g., dipropylene glycol, are also useful to facilitate the solubilization of some perfume ingredients in the composition of the present invention.

Typically, glycol is added to the composition of the present invention at a level of from about 0.01% to about 3%, by weight of the composition, preferably from about 0.05% to about 1%, more preferably from about 0.1% to about 0.5%, by weight of the composition. The preferred weight ratio of low molecular weight polyol to cyclodextrin is from about 2:1,000 to about 20:100, more preferably from about 3:1,000 to about 15:100, even more preferably from about 5:1,000 to about 10:100, and most preferably from about 1:100 to about 7:100.

(b). Metal Salts

Optionally, but highly preferred, the present invention can include metallic salts for added odor absorption and/or antimicrobial benefit for the cyclodextrin solution when cyclodextrin is present. The metallic salts are selected from the group consisting of copper salts, zinc salts, and mixtures thereof.

Copper salts have some antimicrobial benefits. Specifically, cupric abietate acts as a fungicide, copper acetate acts as a mildew inhibitor, cupric chloride acts as a fungicide, copper lactate acts as a fungicide, and copper sulfate acts as a germicide. Copper salts also possess some malodor control abilities. See U.S. Pat. No. 3,172,817, Leupold, et al., which discloses deodorizing compositions for treating disposable articles, comprising at least slightly water-soluble salts of acylacetone, including copper salts and zinc salts, all of said patents are incorporated herein by reference.

The preferred zinc salts possess malodor control abilities. Zinc has been used most often for its ability to ameliorate malodor, e.g., in mouth wash products, as disclosed in U.S. Pat. No. 4,325,939, issued Apr. 20, 1982 and U.S. Pat. No. 4,469,674, issued Sep. 4, 1983, to N. B. Shah, et al., all of which are incorporated herein by reference. Highly-ionized and soluble zinc salts such as zinc chloride, provide the best source of zinc ions. Zinc borate functions as a fungistat and a mildew inhibitor, zinc caprylate functions as a fungicide, zinc chloride provides antiseptic and deodorant benefits, zinc ricinoleate functions as a fungicide, zinc sulfate heptahydrate functions as a fungicide and zinc undecylenate functions as a fungistat.

Preferably the metallic salts are water-soluble zinc salts, copper salts or mixtures thereof, and more preferably zinc salts, especially $ZnCl_2$. These salts are preferably present in the present invention primarily to absorb amine and sulfur-containing compounds that have molecular sizes too small to be effectively complexed with the cyclodextrin molecules. Low molecular weight sulfur-containing materials, e.g., sulfide and mercaptans, are components of many types of malodors, e.g., food odors (garlic, onion), body/perspiration odor, breath odor, etc. Low molecular weight amines are also components of many malodors, e.g., food odors, body odors, urine, etc.

When metallic salts are added to the composition of the present invention they are typically present at a level of from about 0.1% to about 10%, preferably from about 0.2% to about 8%, more preferably from about 0.3% to about 5% by weight of the usage composition. When zinc salts are used as the metallic salt, and a clear solution is desired, it is preferable that the pH of the solution is adjusted to less than about 7, more preferably less than about 6, most preferably, less than about 5, in order to keep the solution clear.

(c). Soluble Carbonate and/or Bicarbonate Salts

Water-soluble alkali metal carbonate and/or bicarbonate salts, such as sodium bicarbonate, potassium bicarbonate, potassium carbonate, cesium carbonate, sodium carbonate, and mixtures thereof can be added to the composition of the present invention in order to help to control certain acid-type odors. Preferred salts are sodium carbonate monohydrate, potassium carbonate, sodium bicarbonate, potassium bicarbonate, and mixtures thereof. When these salts are added to the composition of the present invention, they are typically present at a level of from about 0.1% to about 5%, preferably from about 0.2% to about 3%, more preferably from about 0.3% to about 2%, by weight of the composition. When these salts are added to the composition of the present invention it is preferably that incompatible metal salts not be present in the invention. Preferably, when these salts are used the composition should be essentially free of zinc and other incompatible metal ions, e.g., Ca, Fe, Ba, etc. which form water-insoluble salts.

(d). Mixtures Thereof

Mixtures of the above materials are desirable, especially when the mixture provides control over a broader range of odors.

Perfume

The composition of the present invention can also optionally provide a "scent signal" in the form of a pleasant odor which provides a freshness impression to the treated fabrics. The scent signal can be designed to provide a fleeting perfume scent. When perfume is added as a scent signal, it is added only at very low levels, e.g., from about 0.001% to about 0.5%, preferably from about 0.003% to about 0.3%, more preferably from about 0.005% to about 0.2%, by weight of the usage composition.

Perfume can also be added as a more intense odor in product and on fabrics. When stronger levels of perfume are preferred, relatively higher levels of perfume can be added.

Any type of perfume can be incorporated into the composition of the present invention. The preferred perfume ingredients are those suitable for use to apply on fabrics and garments. Typical examples of such preferred ingredients are given in U.S. Pat. No. 5,445,747, issued Aug. 29, 1995 to Kvietok et al., incorporated herein by reference.

When long lasting fragrance odor on fabrics is desired, it is preferred to use at least an effective amount of perfume ingredients which have a boiling point of about 240° C. or higher, preferably of about 250° C. or higher. Nonlimiting examples of such preferred ingredients are given in U.S. Pat. No. 5,500,138, issued Mar. 19, 1996 to Bacon et al., incorporated herein by reference. It is also preferred to use materials that can slowly release perfume ingredients after the fabric is treated by the color improvement composition of this invention. Examples of materials of this type are given in U.S. Pat. No. 5,531,910, Severns et al., issued Jul. 2, 1996, said patent being incorporated herein by reference.

When cyclodextrin is present, it is essential that the perfume be added at a level wherein even if all of the perfume in the composition were to complex with the cyclodextrin molecules when cyclodextrin is present, there will still be an effective level of uncomplexed cyclodextrin molecules present in the solution to provide adequate odor control. In order to reserve an effective amount of cyclodextrin molecules for odor control when cyclodextrin is present, perfume is typically present at a level wherein less than about 90% of the cyclodextrin complexes with the perfume, preferably less than about 50% of the cyclodextrin complexes with the perfume, more preferably, less than about 30% of the cyclodextrin complexes with the perfume, and most preferably, less than about 10% of the cyclodextrin complexes with the perfume. The cyclodextrin to perfume weight ratio should be greater than about 8:1, preferably greater than about 10:1, more preferably greater than about 20:1, even more preferably greater than 40:1 and most preferably greater than about 70:1.

Preferably the perfume is hydrophilic and is composed predominantly of ingredients selected from two groups of ingredients, namely, (a) hydrophilic ingredients having a ClogP of less than about 3.5, more preferably less than about 3.0, and (b) ingredients having significant low detection threshold, and mixtures thereof. Typically, at least about 50%, preferably at least about 60%, more preferably at least about 70%, and most preferably at least about 80% by weight of the perfume is composed of perfume ingredients of the above groups (a) and (b). For these preferred perfumes, the cyclodextrin to perfume weight ratio is typically of from about 2:1 to about 200:1; preferably from about 4:1 to about 100:1, more preferably from about 6:1 to about 50:1, and even more preferably from about 8:1 to about 30:1.

(a). Hydrophilic Perfume Ingredients

The hydrophilic perfume ingredients are more soluble in water, have less of a tendency to complex with the cyclodextrins, and are more available in the odor absorbing composition than the ingredients of conventional perfumes. The degree of hydrophobicity of a perfume ingredient can be correlated with its octanol/water partition coefficient P. The octanol/water partition coefficient of a perfume ingredient is the ratio between its equilibrium concentration in octanol and in water. A perfume ingredient with a greater partition coefficient P is considered to be more hydrophobic. Conversely, a perfume ingredient with a smaller partition coefficient P is considered to be more hydrophilic. Since the partition coefficients of the perfume ingredients normally have high values, they are more conveniently given in the form of their logarithm to the base 10, logP. Thus the preferred perfume hydrophilic perfume ingredients of this invention have logP of about 3.5 or smaller, preferably of about 3.0 or smaller.

The logP of many perfume ingredients have been reported; for example, the Pomona92 database, available from Daylight Chemical Information Systems, Inc. (Daylight CIS), Irvine, Calif., contains many, along with citations to the original literature. However, the logP values are most conveniently calculated by the "CLOGP" program, also available from Daylight CIS. This program also lists experimental logP values when they are available in the Pomona92 database. The "calculated logP" (ClogP) is determined by the fragment approach of Hansch and Leo (cf., A. Leo, in Comprehensive Medicinal Chemistry, Vol. 4, C. Hansch, P. G. Sammens, J. B. Taylor and C. A. Ramsden, Eds., p. 295, Pergamon Press, 1990, incorporated herein by reference). The fragment approach is based on the chemical structure of each perfume ingredient, and takes into account the numbers and types of atoms, the atom connectivity, and chemical bonding. The ClogP values, which are the most reliable and widely used estimates for this physicochemical property, are used instead of the experimental logP values in the selection of perfume ingredients which are useful in the present invention.

Non-limiting examples of the more preferred hydrophilic perfume ingredients are allyl amyl glycolate, allyl caproate, amyl acetate, amyl propionate, anisic aldehyde, anisyl acetate, anisole, benzaldehyde, benzyl acetate, benzyl acetone, benzyl alcohol, benzyl formate, benzyl iso valerate, benzyl propionate, beta gamma hexenol, calone, camphor gum, laevo-carveol, d-carvone, laevo-carvone, cinnamic alcohol, cinnamyl acetate, cinnamic alcohol, cinnamyl formate, cinnamyl propionate, cis-jasmone, cis-3-hexenyl acetate, coumarin, cuminic alcohol, cuminic aldehyde, Cyclal C, cyclogalbanate, dihydroeuginol, dihydro isojasmonate, dimethyl benzyl carbinol, dimethyl benzyl carbinyl acetate, ethyl acetate, ethyl aceto acetate, ethyl amyl ketone, ethyl anthranilate, ethyl benzoate, ethyl butyrate, ethyl cinnamate, ethyl hexyl ketone, ethyl maltol, ethyl-2-methyl butyrate, ethyl methylphenyl glycidate, ethyl phenyl acetate, ethyl salicylate, ethyl vanillin, eucalyptol, eugenol, eugenyl acetate, eugenyl formate, eugenyl methyl ether, fenchyl alcohol, flor acetate (tricyclo decenyl acetate), fructone, frutene (tricyclo decenyl propionate), geraniol, geranyl oxyacetaldehyde, heliotropin, hexenol, hexenyl acetate, hexyl acetate, hexyl formate, hinokitiol, hydrotropic alcohol, hydroxycitronellal, hydroxycitronellal diethyl acetal, hydroxycitronellol, indole, isoamyl alcohol, iso cyclo citral, isoeugenol, isoeugenyl acetate, isomenthone, isopulegyl acetate, isoquinoline, keone, ligustral, linalool, linalool oxide, linalyl formate, lyral, menthone, methyl acetophenone, methyl amyl ketone, methyl anthranilate, methyl benzoate, methyl benzyl acetate, methyl cinnamate, methyl dihydrojasmonate, methyl eugenol, methyl heptenone, methyl heptine carbonate, methyl heptyl ketone, methyl hexyl ketone, methyl isobutenyl tetrahydropyran, methyl-N-methyl anthranilate, methyl beta naphthyl ketone, methyl phenyl carbinyl acetate, methyl salicylate, nerol, nonalactone, octalactone, octyl alcohol (octanol-2), para-anisic aldehyde, para-cresol, para-cresyl methyl ether, para hydroxy phenyl butanone, para-methoxy acetophenone, para-methyl acetophenone, phenoxy ethanol, phenoxyethyl propionate, phenyl acetaldehyde, phenylacetaldehyde diethyl ether, phenylethyl oxyacetaldehyde, phenyl ethyl acetate, phenyl ethyl alcohol, phenyl ethyl dimethyl carbinol, prenyl acetate, propyl butyrate, pulegone, rose oxide, safrole, terpineol, vanillin, viridine, and mixtures thereof.

Nonlimiting examples of other preferred hydrophilic perfume ingredients which can be used in perfume compositions of this invention are allyl heptoate, amyl benzoate, anethole, benzophenone, carvacrol, citral, citronellol, citronellyl nitrile, cyclohexyl ethyl acetate, cymal, 4-decenal, dihydro isojasmonate, dihydro myrcenol, ethyl methyl phenyl glycidate, fenchyl acetate, florhydral, gamma-nonalactone, geranyl formate, geranyl nitrile, hexenyl isobutyrate, alpha-ionone, isobornyl acetate, isobutyl benzoate, isononyl alcohol, isomenthol, para-isopropyl phenylacetaldehyde, isopulegol, linalyl acetate, 2-methoxy naphthalene, menthyl acetate, methyl chavicol, musk ketone, beta naphthol methyl ether, neral, nonyl aldehyde, phenyl heptanol, phenyl hexanol, terpinyl acetate, Veratrol, yara-yara, and mixtures thereof.

The preferred perfume compositions used in the present invention contain at least 4 different hydrophilic perfume ingredients, preferably at least 5 different hydrophilic perfume ingredients, more preferably at least 6 different hydrophilic perfume ingredients, and even more preferably at least 7 different hydrophilic perfume ingredients. Most common perfume ingredients which are derived from natural sources are composed of a multitude of components. When each such material is used in the formulation of the preferred perfume compositions of the present invention, it is counted as one single ingredient, for the purpose of defining the invention.

(b). Low Odor Detection Threshold Perfume Ingredients

The odor detection threshold of an odorous material is the lowest vapor concentration of that material which can be olfactorily detected. The odor detection threshold and some odor detection threshold values are discussed in, e.g., "Standardized Human Olfactory Thresholds", M. Devos et al, IRL Press at Oxford University Press, 1990, and "Compilation of Odor and Taste Threshold Values Data", F. A. Fazzalari, editor, ASTM Data Series DS 48A, American Society for Testing and Materials, 1978, both of said publications being incorporated by reference. The use of small amounts of perfume ingredients that have low odor detection threshold values can improve perfume odor character, even though they are not as hydrophilic as perfume ingredients of group (a) which are given hereinabove. Perfume ingredients that do not belong to group (a) above, but have a significantly low detection threshold, useful in the composition of the present invention, are selected from the group consisting of ambrox, bacdanol, benzyl salicylate, butyl anthranilate, cetalox, damascenone, alpha-damascone, gamma-dodecalactone, ebanol, herbavert, cis-3-hexenyl salicylate, alpha-ionone, beta-ionone, alpha-isomethylionone, lilial, methyl nonyl ketone, gamma-undecalactone, undecylenic aldehyde, and mixtures thereof. These materials are preferably present at low levels in addition to the hydrophilic ingredients of group (a), typically less than about 20%, preferably less than about 15%, more preferably less than about 10%, by weight of the total perfume compositions of the present invention. However, only low levels are required to provide an effect.

There are also hydrophilic ingredients of group (a) that have a significantly low detection threshold, and are especially useful in the composition of the present invention. Examples of these ingredients are allyl amyl glycolate, anethole, benzyl acetone, calone, cinnamic alcohol, coumarin, cyclogalbanate, Cyclal C, cymal, 4-decenal, dihydro isojasmonate, ethyl anthranilate, ethyl-2-methyl butyrate, ethyl methylphenyl glycidate, ethyl vanillin, eugenol, flor acetate, florhydral, fructone, frutene, heliotropin, keone, indole, iso cyclo citral, isoeugenol, lyral, methyl heptine carbonate, linalool, methyl anthranilate, methyl dihydrojasmonate, methyl isobutenyl tetrahydropyran, methyl beta naphthyl ketone, beta naphthol methyl ether, nerol, para-anisic aldehyde, para hydroxy phenyl butanone, phenyl acetaldehyde, vanillin, and mixtures thereof. Use of low odor detection threshold perfume ingredients minimizes the level of organic material that is released into the atmosphere.

Antimicrobial Active

Optionally, the color improvement composition of the present invention comprise an effective amount, to kill, or reduce the growth of microbes, of antimicrobial active; preferably from about 0.001% to about 2%, more preferably from about 0.002% to about 1%, even more preferably from about 0.003% to about 0.3%, by weight of the usage composition. The effective antimicrobial active can function as disinfectants/sanitizers, and is useful in providing protection against organisms that become attached to the fabrics.

Given below are nonlimiting examples of antimicrobial actives which are useful in the present invention:

Pyrithiones, especially the zinc complex (ZPT); Octopirox; parabens, including methylparaben, propylparaben, butylparaben, ethylparaben, isopropylparaben, isobutylparaben, benzylparaben, sodium methylparaben, and sodium propylparaben; DMDM hydantoin (Glydant); methylchloroisothiazolinone/methylisothiazolinone (Kathon CG); sodium sulfite; sodium bisulfite; imidazolidinyl urea; diazolidinyl urea (Germail 2); sorbic acid/potassium sorbate; dehydroacetic acid/sodium dehydroacetate; benzyl alcohol; sodium borate; 2-bromo-2-nitropropane-1,3-diol (Bronopol); formalin; iodopropynyl butylcarbamate; boric acid; chloroacetamide; methenamine; methyldibromo glutaronitrile; glutaraldehyde; hexamidine isethionate; 5-bromo-5-nitro-1,3-dioxane; phenethyl alcohol; o-phenylphenol/sodium o-phenylphenol; sodium hydroxymethylglycinate; polymethoxy bicyclic oxazolidine; dimethoxane; thimersol; dichlorobenzyl alcohol; captan; chlorphenenesin; dichlorophene; chlorbutanol; phenoxyethanol; phenoxyisopropanol; halogenated diphenyl ethers; 2,4,4'-trichloro-2'-hydroxy-diphenyl ether (Triclosan); 2,2'-dihydroxy-5,5'-dibromo-diphenyl ether;

Phenolic Compounds—(including phenol and its homologs, mono- and poly-alkyl and aromatic halophenols, resorcinol and its derivatives, bisphenolic compounds and halogenated salicylanilides); phenol and its homologs including phenol, 2-methyl phenol, 3-methyl phenol, 4-methyl phenol, 4-ethyl phenol, 2,4-dimethyl phenol, 2,5-dimethyl phenol, 3,4-dimethyl phenol, 2,6-dimethyl phenol, 4-n-propyl phenol, 4-n-butyl phenol, 4-n-amyl phenol, 4-tert-amyl phenol, 4-n-hexyl phenol, and 4-n-heptyl phenol; mono- and poly-alkyl and aromatic halophenols including p-chlorophenol, methyl p-chlorophenol, ethyl p-chlorophenol, n-propyl p-chlorophenol, n-butyl p-chlorophenol, n-amyl p-chlorophenol, sec-amyl p-chlorophenol, n-hexyl p-chlorophenol, cyclohexyl p-chlorophenol, n-heptyl p-chlorophenol, n-octyl p-chlorophenol, o-chlorophenol, methyl o-chlorophenol, ethyl o-chlorophenol, n-propyl o-chlorophenol, n-butyl o-chlorophenol, n-amyl o-chlorophenol, tert-amyl o-chlorophenol, n-hexyl o-chlorophenol, n-heptyl o-chlorophenol, o-benzyl p-chlorophenol, o-benzyl-m-methyl p-chlorophenol, o-benzyl-m, m-dimethyl p-chlorophenol, o-phenylethyl p-chlorophenol, o-phenylethyl-m-methyl p-chlorophenol, 3-methyl p-chlorophenol, 3,5-dimethyl p-chlorophenol, 6-ethyl-3-methyl p-chlorophenol, 6-n-propyl-3-methyl p-chlorophenol, 6-iso-propyl-3-methyl p-chlorophenol, 2-ethyl-3,5-dimethyl p-chlorophenol, 6-sec-butyl-3-methyl p-chlorophenol, 2-iso-propyl-3,5-dimethyl p-chlorophenol, 6-diethylmethyl-3-methyl p-chlorophenol, 6-iso-propyl-2-ethyl-3-methyl p-chlorophenol, 2-sec-amyl-3,5-dimethyl p-chlorophenol, 2-diethylmethyl-3,5-dimethyl p-chlorophenol, 6-sec-octyl-3-methyl p-chlorophenol, p-chloro-m-cresol, p-bromophenol, methyl p-bromophenol, ethyl p-bromophenol, n-propyl p-bromophenol, n-butyl p-bromophenol, n-amyl p-bromophenol, sec-amyl p-bromophenol, n-hexyl p-bromophenol, cyclohexyl p-bromophenol, o-bromophenol, tert-amyl o-bromophenol, n-hexyl o-bromophenol, n-propyl-m,m-dimethyl o-bromophenol, 2-phenyl phenol, 4-chloro-2-methyl phenol, 4-chloro-3-methyl phenol, 4-chloro-3,5-dimethyl phenol, 2,4-dichloro-3,5-dimethylphenol, 3,4,5,6-terabromo-2-methylphenol, 5-methyl-2-pentylphenol, 4-isopropyl-3-methylphenol, para-chloro-meta-xylenol (pcmx), 5-chloro-2-hydroxydiphenylmethane; resorcinol and its derivatives including resorcinol, methyl resorcinol, ethyl resorcinol, n-propyl resorcinol, n-butyl resorcinol, n-amyl resorcinol, n-hexyl resorcinol, n-heptyl resorcinol, n-octyl resorcinol, n-nonyl resorcinol, phenyl resorcinol, benzyl resorcinol, phenylethyl resorcinol, phenylpropyl resorcinol, p-chlorobenzyl resorcinol, 5-chloro 2,4-dihydroxydiphenyl methane, 4'-chloro 2,4-dihydroxydiphenyl methane, 5-bromo 2,4-dihydroxydiphenyl methane, and 4'-bromo 2,4-dihydroxydiphenyl methane; bisphenolic compounds including 2,2'-, methylene bis (4-chlorophenol), 2,2'-methylene bis (3,4,6-trichlorophenol), 2,2'-methylene bis (4-chloro-6-bromophenol), bis (2-hydroxy-3,5-dichlorophenyl) sulphide, and bis (2-hydroxy-5-chlorobenzyl)sulphide; benzoic esters including p-hydroxybenzoic acid, methyl p-hydroxybenzoic acid, ethyl p-hydroxybenzoic acid, propyl p-hydroxybenzoic acid, and butyl p-hydroxybenzoic acid.

Another class of antibacterial agents, which are useful in the present invention, are the so-called "natural" antibacterial actives, referred to as natural essential oils. These actives derive their names from their natural occurrence in plants. Typical natural essential oil antibacterial actives include oils of anise, lemon, orange, rosemary, wintergreen, thyme, lavender, cloves, hops, tea tree, citronella, wheat, barley, lemongrass, cedar leaf, cedarwood, cinnamon, fleagrass, geranium, sandalwood, violet, cranberry, eucalyptus, vervain, peppermint, gum benzoin, *Hydastis carradensis, Berberidaceae. daceae, Ratanhiae* and *Curcuma longa*. Also included in this class of natural essential oils are the key chemical components of the plant oils which have been found to provide the antimicrobial benefit. These chemicals include, but are not limited to anethol, catechole, camphene, thymol, eugenol, eucalyptol, ferulic acid, farnesol, hinokitiol, tropolone, limonene, menthol, methyl salicylate, salicylic acid, thymol, terpineol, verbenone, berberine, ratanhiae extract, caryophellene oxide, citronellic acid, curcumin, nerolidol, geraniol and benzoic acid.

Additional active agents are antibacterial metal salts. This class generally includes salts of metals in groups 3b–7b, 8 and 3a–5a. Specifically are the salts of aluminum, zirconium, zinc, silver, gold, copper, lanthanum, tin, mercury, bismuth, selenium, strontium, scandium, yttrium, cerium, praseodymiun, neodymium, promethum, samarium, europium, gadolinium, terbium, dysprosium, holmium, erbium, thulium, ytterbium, lutetium and mixtures thereof.

Preferred antimicrobial agents for use herein are the broad spectrum actives selected from the group consisting of Triclosan, phenoxyisopropanol, phenoxyethanol, PCMX, natural essential oils and their key ingredients, and mixtures thereof. The most preferred antimicrobial active for use in the present invention is Triclosan.

Quaternary Compounds.

A wide range of quaternary compounds can also be used as antimicrobial actives, in conjunction with the preferred surfactants, for compositions of the present invention. Non-limiting examples of useful quaternary compounds include: (1) benzalkonium chlorides and/or substituted benzalkonium chlorides such as commercially available Barquat® (available from Lonza), Maquat® (available from Mason), Variquat® (available from Witco/Sherex), and Hyamine® (available from Lonza); (2) di($C_6$–$C_{14}$)alkyl di-short chain ($C_{1-4}$ alkyl and/or hydroxyalkyl) quaternary such as Bardac® products of Lonza. These quaternary compounds contain two relatively short chains, e.g., $C_{1-4}$ alkyl and/or hydroxy alkyl groups and two $C_{6-12}$, preferably $C_{6-10}$, and more preferably $C_8$, alkyl groups, (3) N-(3-chloroallyl) hexaminium chlorides such as Dowicide® and Dowicil® available from Dow; (4) benzethonium chloride such as Hyamine® 1622 from Rohm & Haas; (5) methylbenzethonium chloride represented by Hyamine® 10X supplied by Rohm & Haas, (6) cetylpyridinium chloride such as Cepacol chloride available from of Merrell Labs. Examples of the preferred dialkyl quaternary compounds are di($C_8$–$C_{12}$) dialkyl dimethyl ammonium chloride, such as didecyldimethylammonium chloride (Bardac 22), and dioctyldimethylammonium chloride (Bardac 2050). Typical concentrations for biocidal effectiveness of these quaternary compounds range from about 0.001% to about 0.8%, preferably from about 0.005% to about 0.3%, more preferably from about 0.01% to 0.2%, by weight of the usage composition. The corresponding concentrations for the concentrated compositions are from about 0.003% to about 2%, preferably from about 0.006% to about 1.2%, and more preferably from about 0.1% to about 0.8% by weight of the concentrated compositions.

When cyclodextrin is present, the solubilized, water-soluble antimicrobial active is useful in providing protection against organisms that become attached to the treated fabrics. The antimicrobial should be cyclodextrin-compatible, e.g., not substantially forming complexes with the cyclodextrin in the odor absorbing composition when cyclodextrin is present. The free, uncomplexed antimicrobial, e.g., antibacterial, active provides an optimum antibacterial performance.

Sanitization of fabrics can be achieved by the compositions of the present invention containing, antimicrobial materials, e.g., antibacterial halogenated compounds, quaternary compounds, and phenolic compounds. Some of the more robust cyclodextrin-compatible antimicrobial halogenated compounds which can function as disinfectants/sanitizers as well as finish product preservatives (vide infra), and are useful in the compositions of the present invention include 1,1'-hexamethylene bis(5-(p-chlorophenyl) biguanide), commonly known as chlorhexidine, and its salts, e.g., with hydrochloric, acetic and gluconic acids. The digluconate salt is highly water-soluble, about 70% in water, and the diacetate salt has a solubility of about 1.8% in water. When chlorhexidine is used as a sanitizer in the present invention it is typically present at a level of from about 0.001% to about 0.4%, preferably from about 0.002% to about 0.3%, and more preferably from about 0.05% to about 0.2%, by weight of the usage composition. In some cases, a level of from about 1% to about 2% may be needed for virucidal activity.

Aminocarboxylate Chelators

Chelators, e.g., ethylenediaminetetraacetic acid (EDTA), hydroxyethylenediaminetriacetic acid, diethylenetriaminepentaacetic acid, and other aminocarboxylate chelators, and mixtures thereof, and their salts, and mixtures thereof, can optionally be used to increase antimicrobial and preservative effectiveness against Gram-negative bacteria, especially *Pseudomonas* species. Although sensitivity to EDTA and other aminocarboxylate chelators is mainly a characteristic of *Pseudomonas* species, other bacterial species highly susceptible to chelators include *Achromobacter, Alcaligenes, Azotobacter, Escherichia, Salmonella, Spirillum*, and *Vibrio*. Other groups of organisms also show increased sensitivities to these chelators, including fungi and yeasts. Furthermore, aminocarboxylate chelators can help, e.g., maintaining product clarity, protecting fragrance and perfume components, and preventing rancidity and off odors.

Although these aminocarboxylate chelators may not be potent biocides in their own right, they function as potentiators for improving the performance of other antimicrobials/preservatives in the compositions of the present invention. Aminocarboxylate chelators can potentiate the performance of many of the cationic, anionic, and nonionic antimicrobials/preservatives, phenolic compounds, and isothiazolinones, that are used as antimicrobials/preservatives in the composition of the present invention. Nonlimiting examples of cationic antimicrobials/preservatives potentiated by aminocarboxylate chelators in solutions are chlorhexidine salts (including digluconate, diacetate, and dihydrochloride salts), and Quaternium-15, also known as Dowicil 200, Dowicide Q, Preventol D1, benzalkonium chloride, cetrimonium, myristalkonium chloride, cetylpyridinium chloride, lauryl pyridinium chloride, and the like. Nonlimiting examples of useful anionic antimicrobials/preservatives which are enhanced by aminocarboxylate chelators are sorbic acid and potassium sorbate. Nonlimiting examples of useful nonionic antimicrobials/preservatives which are potentiated by aminocarboxylate chelators are DMDM hydantoin, phenethyl alcohol, monolaurin, imidazolidinyl urea, and Bronopol (2-bromo-2-nitropropane-1,3-diol).

Examples of useful phenolic antimicrobials/preservatives potentiated by these chelators are chloroxylenol, phenol, tert-butyl hydroxyanisole, salicylic acid, resorcinol, and sodium o-phenyl phenate. Nonlimiting examples of isothiazolinone antimicrobials/preservatives which are enhanced by aminocarboxylate chelators are Kathon, Proxel and Promexal.

The optional chelators are present in the compositions of this invention at levels of, typically, from about 0.01% to about 0.3%, more preferably from about 0.02% to about 0.1%, most preferably from about 0.02% to about 0.05% by weight of the usage compositions to provide antimicrobial efficacy in this invention.

Free, uncomplexed aminocarboxylate chelators are required to potentiate the efficacy of the antimicrobials. Thus, when excess alkaline earth (especially calcium and magnesium) and transitional metals (iron, manganese, copper, and others) are present, free chelators are not available and antimicrobial potentiation is not observed. In the case where significant water hardness or transitional metals are available or where product esthetics require a specified chelator level, higher levels may be required to allow for the availability of free, uncomplexed aminocarboxylate chelators to function as antimicrobial/preservative potentiators.

Antimicrobial Preservative

Optionally, but preferably, an antimicrobial preservative can be added to the composition of the present invention, preferably solubilized, water-soluble, antimicrobial preservative, to protect the fabric color care active and/or other easily degradable organic ingredients such as natural polysaccharides, because these molecules are made up, e.g., of varying numbers of glucose units which can make them a prime breeding ground for certain microorganisms, especially when in aqueous compositions. This drawback can lead to the problem of storage stability of fabric care solutions for any significant length of time. Contamination by certain microorganisms with subsequent microbial growth can result in an unsightly and/or malodorous solution. Because microbial growth in the fabric care solutions is highly objectionable when it occurs, it is highly preferable to include an antimicrobial preservative, preferably solubilized, water-soluble, antimicrobial preservative, which is effective for inhibiting and/or regulating microbial growth in order to increase storage stability of the preferably clear, aqueous odor-absorbing solution containing the fabric color care active.

It is preferable to use a broad spectrum preservative, e.g., one that is effective on both bacteria (both gram positive and gram negative) and fungi. A limited spectrum preservative, e.g., one that is only effective on a single group of microorganisms, e.g., fungi, can be used in combination with a broad spectrum preservative or other limited spectrum preservatives with complimentary and/or supplementary activity. A mixture of broad spectrum preservatives can also be used. In some cases where a specific group of microbial contaminants is problematic (such as Gram negatives), aminocarboxylate chelators can be used alone or as potentiators in conjunction with other preservatives.

These chelators which include, e.g., ethylenediaminetetraacetic acid (EDTA), hydroxyethylenediaminetriacetic acid, diethylenetriaminepentaacetic acid, and other aminocarboxylate chelators, and mixtures thereof, and their salts, and mixtures thereof, can increase preservative effectiveness against Gram-negative bacteria, especially *Pseudomonas* species.

Antimicrobial preservatives useful in the present invention include biocidal compounds, i.e., substances that kill microorganisms, or biostatic compounds, i.e., substances that inhibit and/or regulate the growth of microorganisms. Suitable preservatives are disclosed in U.S. Pat. No. 5,534,165; 5,578,563; 5,663,134; 5,668,097; 5,670,475; and 5,714,137, Trinh et al. issued Jul. 9, 1996; Nov. 26, 1996; Sep. 2, 1997; Sep. 16, 1997; Sep. 23, 1997; and Feb. 3, 1998 respectively, all of said patents being incorporated hereinbefore by reference. Many antimicrobial preservatives are given under the section on Antimicrobial Active given herein above. Water insoluble antimicrobial preservatives such as paraben and triclosan are useful in the fabric care compositions of the present invention, but they require the use of a solubilizer, an emulsifier, a dispersing agent, or the like, such as a surfactant and/or cyclodextrin to effectively distribute said preservative in the liquid composition. Preferred antimicrobial preservatives are those that are water-soluble and are effective at low levels. Water-soluble preservatives useful in the present invention are those that have a solubility in water of at least about 0.3 g per 100 ml of water, i.e., greater than about 0.3% at room temperature, preferably greater than about 0.5% at room temperature.

The water-soluble antimicrobial preservative in the present invention is included at an effective amount. The term "effective amount" as herein defined means a level sufficient to prevent spoilage, or prevent growth of inadvertently added microorganisms, for a specific period of time. In other words, the preservative is not being used to kill microorganisms on the surface onto which the composition is deposited in order to eliminate odors produced by microorganisms. Instead, it is preferably being used to prevent spoilage of the fabric color care active solution in order to increase the shelf-life of the composition. Preferred levels of preservative are from about 0.0001% to about 0.5%, more preferably from about 0.0002% to about 0.2%, most preferably from about 0.0003% to about 0.1%, by weight of the usage composition.

The preservative can be any organic preservative material which will not cause damage to fabric appearance, e.g., discoloration, coloration, bleaching. Preferred water-soluble preservatives include organic sulfur compounds, halogenated compounds, cyclic organic nitrogen compounds, low molecular weight aldehydes, quaternary ammonium compounds, dehydroacetic acid, phenyl and phenolic compounds, and mixtures thereof.

The preservatives of the present invention can be used in mixtures in order to control a broad range of microorganisms.

Bacteriostatic effects can sometimes be obtained for aqueous compositions by adjusting the composition pH to an acid pH, e.g., less than about pH 4, preferably less than about pH 3, or a basic pH, e.g., greater than about 10, preferably greater than about 11.

Antistatic Agents

The composition of the present invention can optionally contain an effective amount of antistatic agent to provide the treated clothes with in-wear static. Preferred antistatic agents are those that are water soluble in at least an effective amount, such that the composition remains a clear solution. Examples of these antistatic agents are monoalkyl cationic quaternary ammonium compounds, e.g., mono($C_{10}$–$C_{14}$ alkyl)trimethyl ammonium halide, such as monolauryl trimethyl ammonium chloride, hydroxycetyl hydroxyethyl dimethyl ammonium chloride, available under the trade name Dehyquart E® from Henkel, and ethyl bis(polyethoxy ethanol) alkylammonium ethylsulfate, available under the trade name Variquat 66® from Witco Corp., polyethylene glycols, polymeric quaternary ammonium salts, such as polymers conforming to the general formula:

$$-[N(CH_3)_2-(CH_2)_3-NH-CO-NH-(CH_2)_3-N(CH_3)_2^{+}-CH_2CH_2OCH_2CH_2]_x^{2+}2x[Cl^-]$$

available under the trade name Mirapol A-15® from Rhône-Poulenc, and $$-[N(CH_3)_2-(CH_2)_3-NH-CO-(CH_2)_4-CO-NH-(CH_2)_3-N(CH_3)_2-(CH_2CH_2OCH_2CH_2]_x^{+}x[Cl^-],$$

available under the trade name Mirapol AD-1® from Rhône-Poulenc, quaternized polyethyleneimines, vinylpyrrolidone/methacrylamidopropyltrimethylammonium chloride copolymer, available under the trade name Gafquat HS-100® from GAF; triethonium hydrolyzed collagen ethosulfate, available under the trade name Quat-Pro E® from Maybrook; and mixtures thereof.

It is preferred that a no foaming, or low foaming, agent is used, to avoid foam formation during fabric treatment. It is also preferred that polyethoxylated agents such as polyethylene glycol or Variquat 66® are not used when alpha-cyclodextrin is used. The polyethoxylate groups have a strong affinity to, and readily complex with, alpha-cyclodextrin which in turn depletes the uncomplexed cyclodextrin available for odor control.

When an antistatic agent is used it is typically present at a level of from about 0.05% to about 10%, preferably from about 0.1% to about 5%, more preferably from about 0.3% to about 3%, by weight of the usage composition.

Insect and/or Moth Repelling Agent

The composition of the present invention can optionally contain an effective amount of insect and/or moth repelling agents. Typical insect and moth repelling agents are pheromones, such as anti-aggregation pheromones, and other natural and/or synthetic ingredients. Preferred insect and moth repellent agents useful in the composition of the present invention are perfume ingredients, such as citronellol, citronellal, citral, linalool, cedar extract, geranium oil, sandalwood oil, 2-(diethylphenoxy)ethanol, 1-dodecene, etc. Other examples of insect and/or moth repellents useful in the composition of the present invention are disclosed in U.S. Pat. Nos. 4,449,987, 4,693,890, 4,696,676, 4,933,371, 5,030,660, 5,196,200, and in "Semio Activity of Flavor and Fragrance Molecules on Various Insect Species", B. D. Mookherjee et al., published in *Bioactive Volatile Compounds from Plants*, ASC Symposium Series 525, R. Teranishi, R. G. Buttery, and H. Sugisawa, 1993, pp. 35–48, all of said patents and publications being incorporated herein by reference. When an insect and/or moth repellent is used it is typically present at a level of from about 0.005% to about 3%, by weight of the usage composition.

Optional Anti-Clogging Agent

Optional anti-clogging agent which enhances the wetting and anti-clogging properties of the composition, especially when starch is present, is chosen from the group of polymeric glycols of alkanes and olefins having from 2 to about 6, preferably 2 carbon atoms. The anti-clogging agent inhibits the formation of "plugs" in the spray nozzle. An example of the preferred anti-clogging agent is polyethylene glycol having an average molecular weight of from about 800 to about 12,000, more preferably from about 1,400 to about 8,000. When used, the anti-clogging agent is present at a level of from about 0.01% to about 1%, preferably from about 0.05% to about 0.5%, more preferably, from about 0.1% to about 0.3% by weight of the usage composition.

Aqueous Carrier

The preferred carrier of the present invention is water. The water which is used can be distilled, deionized, or tap water. Water is the main liquid carrier due to its low cost, availability, safety, and environmental compatibility. Water serves as the liquid carrier for the fabric color care active and other soluble and/or dispersible optional ingredients.

The level of liquid carrier in the compositions of the present invention is typically greater than about 80%, preferably greater than about 90%, more preferably greater than about 95%, by weight of the composition. When a concentrated composition is used, the level of liquid carrier is typically from about 2% to about 98%, by weight of the composition, preferably from about 35% to about 97%, more preferably from about 60% to about 95%, by weight of the composition.

Optionally, in addition to water, the carrier can contain a low molecular weight organic solvent that is highly soluble in water, e.g., ethanol, propanol, isopropanol, and the like, and mixtures thereof. Low molecular weight alcohols can help the treated fabric to dry faster. The optional solvent is also useful in the solubilization of some shape retention polymers described hereinbefore. The optional water soluble low molecular weight solvent can be used at a level of up to about 50%, typically from about 0.1% to about 25%, preferably from about 2% to about 15%, more preferably from about 5% to about 10%, by weight of the total composition. Factors that need to consider when a high level of solvent is used in the composition are odor, flammability, and environment impact.

II. Article of Manufacture

The present invention can also be comprise an article of manufacture comprising said composition plus a spray dispenser. Preferably the articles of manufacture are in association with a set of instructions for how to use the composition to treat fabrics correctly so as to provide good color, especially one step color restoration, including, e.g., the manner and/or amount of composition to spray, and the preferred ways of handling of the fabrics, as will be described with more detailed herein below where wrinkle control is also desired. It is important that the instructions be as simple and clear as possible, so that using pictures and/or icons is desirable.

Spray Dispenser

The article of manufacture herein comprises a spray dispenser. The fabric color care composition is placed into a spray dispenser in order to be distributed onto the fabric. Said spray dispenser for producing a spray of liquid droplets can be any of the manually activated means as is known in the art, e.g. trigger-type, pump-type, non-aerosol self-pressurized, and aerosol-type spray means, for adding the fabric color care composition to small fabric surface areas and/or a small number of garments, as well as non-manually operated, powered sprayers for conveniently adding the fabric color care composition to large fabric surface areas and/or a large number of garments. The spray dispenser herein does not normally include those that will substantially foam the clear, aqueous fabric color care composition. It has been found that the performance is improved by providing smaller particle droplets. Desirably, the Sauter mean particle diameter is from about 10 $\mu$m to about 120 $\mu$m, more preferably, from about 20 $\mu$m to about 100 $\mu$m. Dewrinkling benefits are improved by providing small particles (droplets), as discussed hereinbefore, especially when the surfactant is present.

The spray dispenser can be an aerosol dispenser. Said aerosol dispenser comprises a container which can be constructed of any of the conventional materials employed in fabricating aerosol containers. The dispenser must be capable of withstanding internal pressure in the range of from about 20 to about 110 p.s.i.g., more preferably from about 20 to about 70 p.s.i.g. The one important requirement concerning the dispenser is that it be provided with a valve member which will permit the clear, aqueous de-wrinkle composition contained in the dispenser to be dispensed in the form of a spray of very fine, or finely divided, particles or droplets. The aerosol dispenser utilizes a pressurized sealed container from which the clear, aqueous de-wrinkle composition is dispensed through a special actuator/valve assembly under pressure. The aerosol dispenser is pressurized by incorporating therein a gaseous component generally known as a propellant. Common aerosol propellants, e.g., gaseous hydrocarbons such as isobutane, and mixed halogenated hydrocarbons, can be used. Halogenated hydrocarbon propellants such as chlorofluoro hydrocarbons have been alleged to contribute to environmental problems, and are not preferred. When cyclodextrin is present hydrocarbon propellants are not preferred, because they can form complexes with the cyclodextrin molecules thereby reducing the availability of uncomplexed cyclodextrin molecules for odor absorption. Preferred propellants are compressed air, nitrogen, inert gases, carbon dioxide, etc. A more complete description of commercially available aerosol-spray dispensers appears in U.S. Pat. No. 3,436,772, Stebbins, issued Apr. 8, 1969; and U.S. Pat. No. 3,600,325, Kaufman et al., issued Aug. 17, 1971; both of said references are incorporated herein by reference.

Preferably the spray dispenser can be a self-pressurized non-aerosol container having a convoluted liner and an elastomeric sleeve. Said self-pressurized dispenser comprises a liner/sleeve assembly containing a thin, flexible radially expandable convoluted plastic liner of from about 0.010 to about 0.020 inch thick, inside an essentially cylindrical elastomeric sleeve. The liner/sleeve is capable of holding a substantial quantity of fabric color care composition product and of causing said product to be dispensed. A more complete description of self-pressurized spray dispensers can be found in U.S. Pat. No. 5,111,971, Winer, issued May 12, 1992, and U.S. Pat. No. 5,232,126, Winer, issued Aug. 3, 1993; both of said references are herein incorporated by reference. Another type of aerosol spray dispenser is one wherein a barrier separates the fabric color care composition from the propellant (preferably compressed air or nitrogen), as disclosed in U.S. Pat. No. 4,260,110, issued Apr. 7, 1981, and incorporated herein by reference. Such a dispenser is available from EP Spray Systems, East Hanover, N.J.

More preferably, the spray dispenser is a non-aerosol, manually activated, pump-spray dispenser. Said pump-spray dispenser comprises a container and a pump mechanism which securely screws or snaps onto the container. The container comprises a vessel for containing the aqueous fabric color care composition to be dispensed.

The pump mechanism comprises a pump chamber of substantially fixed volume, having an opening at the inner end thereof. Within the pump chamber is located a pump stem having a piston on the end thereof disposed for reciprocal motion in the pump chamber. The pump stem has a passageway there through with a dispensing outlet at the outer end of the passageway and an axial inlet port located inwardly thereof.

The container and the pump mechanism can be constructed of any conventional material employed in fabricating pump-spray dispensers, including, but not limited to: polyethylene; polypropylene; polyethyleneterephthalate; blends of polyethylene, vinyl acetate, and rubber elastomer. A preferred container is made of clear, e.g., polyethylene terephthalate. Other materials can include stainless steel. A more complete disclosure of commercially available dispensing devices appears in: U.S. Pat. No. 4,895,279, Schultz, issued Jan. 23, 1990; U.S. Pat. No. 4,735,347, Schultz et al., issued Apr. 5, 1988; and U.S. Pat. No. 4,274,560, Carter, issued Jun. 23, 1981; all of said references are herein incorporated by reference.

Most preferably, the spray dispenser is a manually activated trigger-spray dispenser. Said trigger-spray dispenser comprises a container and a trigger both of which can be constructed of any of the conventional material employed in fabricating trigger-spray dispensers, including, but not limited to: polyethylene; polypropylene; polyacetal; polycarbonate; polyethyleneterephthalate; polyvinyl chloride; polystyrene; blends of polyethylene, vinyl acetate, and rubber elastomer. Other materials can include stainless steel and glass. A preferred container is made of clear, e.g. polyethylene terephthalate. The trigger-spray dispenser does not incorporate a propellant gas into the odor-absorbing composition, and preferably it does not include those that will foam the fabric color care composition. The trigger-spray dispenser herein is typically one which acts upon a discrete amount of the fabric color care composition itself, typically by means of a piston or a collapsing bellows that displaces the composition through a nozzle to create a spray of thin liquid. Said trigger-spray dispenser typically comprises a pump chamber having either a piston or bellows which is movable through a limited stroke response to the trigger for varying the volume of said pump chamber. This pump chamber or bellows chamber collects and holds the product for dispensing. The trigger spray dispenser typically has an outlet check valve for blocking communication and flow of fluid through the nozzle and is responsive to the pressure inside the chamber. For the piston type trigger sprayers, as the trigger is compressed, it acts on the fluid in the chamber and the spring, increasing the pressure on the fluid. For the bellows spray dispenser, as the bellows is compressed, the pressure increases on the fluid. The increase in fluid pressure in either trigger spray dispenser acts to open the top outlet check valve. The top valve allows the product to be forced through the swirl chamber and out the nozzle to form a discharge pattern. An adjustable nozzle cap can be used to vary the pattern of the fluid dispensed.

For the piston spray dispenser, as the trigger is released, the spring acts on the piston to return it to its original position. For the bellows spray dispenser, the bellows acts as the spring to return to its original position. This action causes a vacuum in the chamber. The responding fluid acts to close the outlet valve while opening the inlet valve drawing product up to the chamber from the reservoir.

A more complete disclosure of commercially available dispensing devices appears in U.S. Pat. No. 4,082,223, Nozawa, issued Apr. 4, 1978; U.S. Pat. No. 4,161,288, McKinney, issued Jul. 17, 1985; U.S. Pat. No. 4,434,917, Saito et al., issued Mar. 6, 1984; and U.S. Pat. No. 4,819,835, Tasaki, issued Apr. 11, 1989; U.S. Pat. No. 5,303,867, Peterson, issued Apr. 19, 1994; all of said references are incorporated herein by reference.

A broad array of trigger sprayers or finger pump sprayers are suitable for use with the compositions of this invention. These are readily available from suppliers such as Calmar, Inc., City of Industry, Calif.; CSI (Continental Sprayers, Inc.), St. Peters, Mo.; Berry Plastics Corp., Evansville, Ind., a distributor of Guala® sprayers; or Seaquest Dispensing, Cary, Ill.

The preferred trigger sprayers are the blue inserted Guala® sprayer, available from Berry Plastics Corp., or the Calmar TS800-1A®, TS1300®, and TS-800-2®, available from Calmar Inc., because of the fine uniform spray characteristics, spray volume, and pattern size. More preferred are sprayers with precompression features and finer spray characteristics and even distribution, such as Yoshino sprayers from Japan. Any suitable bottle or container can be used with the trigger sprayer, the preferred bottle is a 17 fl-oz. bottle (about 500 ml) of good ergonomics similar in shape to the Cinch® bottle. It can be made of any materials such as high density polyethylene, polypropylene, polyvinyl chloride, polystyrene, polyethylene terephthalate, glass, or any other material that forms bottles. Preferably, it is made of high density polyethylene or clear polyethylene terephthalate.

For smaller fluid ounce sizes (such as 1 to 8 ounces), a finger pump can be used with canister or cylindrical bottle. The preferred pump for this application is the cylindrical Euromist II® from Seaquest Dispensing. More preferred are those with precompression features.

The article of manufacture herein preferably can also comprise a non-manually operated spray dispenser. By "non-manually operated" it is meant that the spray dispenser can be manually activated, but the force required to dispense the fabric color care composition is provided by another, non-manual means. Non-manually operated sprayers include, but are not limited to, powered sprayers, air aspirated sprayers, liquid aspirated sprayers, electrostatic sprayers, and nebulizer sprayers. The fabric color care composition is placed into a spray dispenser in order to be distributed onto the fabric.

Powered sprayers include self contained powered pumps that pressurize the aqueous de-wrinkle composition and dispense it through a nozzle to produce a spray of liquid droplets. Powered sprayers are attached directly or remotely through the use of piping/tubing to a reservoir (such as a bottle) to hold the aqueous fabric color care composition. Powered sprayers can include, but are not limited to, centrifugal or positive displacement designs. It is preferred that the powered sprayer be powered by a portable DC electrical current from either disposable batteries (such as commercially available alkaline batteries) or rechargeable battery units (such as commercially available nickel cadmium battery units). Powered sprayers can also be powered by standard AC power supply available in most buildings. The discharge nozzle design can be varied to create specific spray characteristics (such as spray diameter and particle size). It is also possible to have multiple spray nozzles for different spray characteristics. The nozzle may or may not contain an adjustable nozzle shroud that would allow the spray characteristics to be altered.

Nonlimiting examples of commercially available powered sprayers are disclosed in U.S. Pat. No. 4,865,255, Luvisotto, issued Sep. 12, 1989 which is incorporated herein by reference. Preferred powered sprayers are readily available from suppliers such as Solo, Newport News, Va. (e.g., Solo Spraystar™ rechargeable sprayer, listed as manual part

#: US 460 395) and Multi-sprayer Systems, Minneapolis, Minn. (e.g., model: Spray 1).

Air aspirated sprayers include the classification of sprayers generically known as "air brushes". A stream of pressurized air draws up the aqueous fabric color care composition and dispenses it through a nozzle to create a spray of liquid. The fabric color care composition can be supplied via separate piping/tubing or more commonly is contained in a jar to which the aspirating sprayer is attached.

Nonlimiting examples of commercially available air aspirated sprayers appears in U.S. Pat. No. 1,536,352, Murray, issued Apr. 22, 1924 and U.S. Pat. No. 4,221,339, Yoshikawa, issues Sep. 9, 1980; all of said references are incorporated herein by reference. Air aspirated sprayers are readily available from suppliers such as The Badger Air-Brush Co., Franklin Park, Ill. (e.g., model #: 155) and Wilton Air Brush Equipment, Woodridge, Ill. (e.g., stock #: 415-4000, 415-4001, 415-4100).

Liquid aspirated sprayers are typical of the variety in widespread use to spray garden chemicals. The aqueous dewrinkling composition is drawn into a fluid stream by means of suction created by a Venturi effect. The high turbulence serves to mix the aqueous fabric color care composition with the fluid stream (typically water) in order to provide a uniform mixture/concentration. It is possible with this method of delivery to dispense the aqueous concentrated fabric color care composition of the present invention and then dilute it to a selected concentration with the delivery stream.

Liquid aspirated sprayers are readily available from suppliers such as Chapin Manufacturing Works, Batavia, N.Y. (e.g., model #: 6006).

Electrostatic sprayers impart energy to the aqueous dewrinkling composition via a high electrical potential. This energy serves to atomize and charge the aqueous fabric color care composition, creating a spray of fine, charged particles. As the charged particles are carried away from the sprayer, their common charge causes them to repel one another. This has two effects before the spray reaches the target. First, it expands the total spray mist. This is especially important when spraying to fairly distant, large areas. The second effect is maintenance of original particle size. Because the particles repel one another, they resist collecting together into large, heavier particles like uncharged particles do. This lessens gravity's influence, and increases the charged particle reaching the target. As the mass of negatively charged particles approach the target, they push electrons inside the target inwardly, leaving all the exposed surfaces of the target with a temporary positive charge. The resulting attraction between the particles and the target overrides the influences of gravity and inertia. As each particle deposits on the target, that spot on the target becomes neutralized and no longer attractive. Therefore, the next free particle is attracted to the spot immediately adjacent and the sequence continues until the entire surface of the target is covered. Hence, charged particles improve distribution and reduce drippage.

Nonlimiting examples of commercially available electrostatic sprayers appears in U.S. Pat. No. 5,222,664, Noakes, issued Jun. 29, 1993; U.S. Pat. No. 4,962,885, Coffee, issued Oct. 16, 1990; U.S. Pat. No. 2,695,002, Miller, issued November 1954; U.S. Pat. No. 5,405,090, Greene, issued Apr. 11, 1995; U.S. Pat. No. 4,752,034, Kuhn, issued Jun. 21, 1988; U.S. Pat. No. 2,989,241, Badger, issued June 1961; all of said patents are incorporated herein by reference. Electrostatic sprayers are readily available from suppliers such as Tae In Tech Co, South Korea and Spectrum, Houston, Tex.

Nebulizer sprayers impart energy to the aqueous dewrinkling composition via ultrasonic energy supplied via a transducer. This energy results in the aqueous fabric color care composition to be atomized. Various types of nebulizers include, but are not limited to, heated, ultrasonic, gas, venturi, and refillable nebulizers.

Nonlimiting examples of commercially available nebulizer sprayers appears in U.S. Pat. No. 3,901,443, Mitsui, issued Aug. 26, 1975; U.S. Pat. No. 2,847,248, Schmitt, issued August 1958; U.S. Pat. No. 5,511,726, Greenspan, issued Apr. 30, 1996; all of said patents are incorporated herein by reference. Nebulizer sprayers are readily available from suppliers such as A&D Engineering, Inc., Milpitas, Calif. (e.g., model A&D Un-231 ultrasonic handy nebulizer) and Amici, Inc., Spring City, Pa. (model: swirler nebulizer).

The preferred article of manufacture herein comprises a non-manually operated sprayer, such as a battery-powered sprayer, containing the aqueous fabric color care composition. More preferably the article of manufacture comprises a combination of a non-manually operated sprayer and a separate container of the aqueous fabric color care composition, to be added to the sprayer before use and/or to be separated for filling/refilling. The separate container can contain an usage composition, or a concentrated composition to be diluted before use, and/or to be used with a diluting sprayer, such as with a liquid aspirated sprayer, as described herein above.

Also, as described hereinbefore, the separate container should have structure that mates with the rest of the sprayer to ensure a solid fit without leakage, even after motion, impact, etc. and when handled by inexperienced consumers. The sprayer desirably can also have an attachment system that is safe and preferably designed to allow for the liquid container to be replaced by another container that is filled. E.g., the fluid reservoir can be replaced by a filled container. This can minimize problems with filling, including minimizing leakage, if the proper mating and sealing means are present on both the sprayer and the container. Desirably, the sprayer can contain a shroud to ensure proper alignment and/or to permit the use of thinner walls on the replacement container. This minimizes the amount of material to be recycled and/or discarded. The package sealing or mating system can be a threaded closure (sprayer) which replaces the existing closure on the filled and threaded container. A gasket is desirably added to provide additional seal security and minimize leakage. The gasket can be broken by action of the sprayer closure. These threaded sealing systems can be based on industry standards. However, it is highly desirable to use a threaded sealing system that has non-standard dimensions to ensure that the proper sprayer/bottle combination is always used. This helps prevent the use of fluids that are toxic, which could then be dispensed when the sprayer is used for its intended purpose.

An alternative sealing system can be based on one or more interlocking lugs and channels. Such systems are commonly referred to as "bayonet" systems. Such systems can be made in a variety of configurations, thus better ensuring that the proper replacement fluid is used. For convenience, the locking system can also be one that enables the provision of a "child-proof" cap on the refill bottle. This "lock-and-key" type of system thus provides highly desirable safety features. There are a variety of ways to design such lock and key sealing systems.

Care must be taken, however, to prevent the system from making the filling and sealing operation too difficult. If desired, the lock and key can be integral to the sealing mechanism. However, for the purpose of ensuring that the correct recharge or refill is used, the interlocking pieces can be separate from the sealing system. E.g., the shroud and the container could be designed for compatibility. In this way, the unique design of the container alone could provide the requisite assurance that the proper recharge/refill is used.

Examples of threaded closures and bayonet systems can be found in U.S. Pat. No. 4,781,311, Nov. 1, 1988 (Angular Positioned Trigger Sprayer with Selective Snap-Screw Container Connection, Clorox), U.S. Pat. No. 5,560,505, Oct. 1, 1996 (Container and Stopper Assembly Locked Together by Relative Rotation and Use Thereof, Cebal SA), and U.S. Pat. No. 5,725,132, Mar. 10, 1998 (Dispenser with Snap-Fit Container Connection, Centico International). All of said patents are incorporated herein by reference.

III. Method of Use

The fabric color care composition, which contains a fabric color care active, and optionally, e.g., perfume, odor control agent including cyclodextrin, antimicrobial actives and/or preservative, surfactant, antioxidant, metal chelating agent including aminocarboxylate chelating agent, antistatic agent, insect and moth repelling agent, fabric softener active, dye transfer inhibiting agent, brightener, soil release agent, dispersant, suds suppressor, and mixtures thereof, can be used by distributing, e.g., by placing, an effective amount of the aqueous solution onto the fabric surface or fabric article to be treated. Distribution can be achieved by using a spray device, a roller, a pad, etc., preferably a spray dispenser. For wrinkle control, for wrinkle removal, an effective amount means an amount sufficient to remove or noticeably reduce the appearance of wrinkles on fabric. Preferably, the amount of fabric care solution is not so much as to saturate or create a pool of liquid on said article or surface and so that when dry there is no visual deposit readily discernible.

An effective amount of the liquid composition of the present invention is preferably sprayed onto fabric and/or fabric articles. When the composition is sprayed onto fabric, an effective amount should be deposited onto the fabric, with the fabric becoming damp or totally saturated with the composition, typically from about 5% to about 150%, preferably from about 10% to about 100%, more preferably from about 20% to about 75%, by weight of the fabric. The treated fabric typically has from about 0.005% to about 4%, preferably from about 0.01% to about 2%, more preferably from about 0.05% to about 1%, by weight of the fabric of said fabric color care active. Once the fabric has been sprayed, it is hung until dry. It is preferable that the treatment is performed in accordance with the instructions for use, to ensure that the consumer knows what benefits can be achieved, and how best to obtain these benefits.

Since the treatment of the worn, faded fabric necessarily changes the intensity of the fabric color, it is essential that the treatment needs to be uniform, either by fully treated the fabric surface with the fabric color care composition, or by uniformly spraying the fabric surface with small droplets of the composition, so that visually the color improvement appears uniform. In other words, preferably, the fabric color care composition is applied uniformly to the entire visible surface of the fabric. Thus, it is preferable that the treatment is performed in accordance with an instruction for use, to ensure that the fabric needs to be applied uniformly to achieve the optimal color restoration and/or rejuvenation benefit.

The spraying means should be capable of providing droplets with a weight average diameter of from about 5 $\mu$m to about 250 $\mu$m, preferably from about 8 $\mu$m to about 120 $\mu$m, more preferably from about 10 $\mu$m to about 80 $\mu$m. When the compositions are applied in the form of the very small particles (droplets), the distribution is further improved and overall performance is also improved. The presence of the optional surfactant promotes spreading of the solution and helps a uniform distribution of the fabric color care active on the fabric surface.

The fabric color care composition can also be applied to fabric via a dipping and/or soaking process followed by a drying step. The application can be done in consumer's home by the use of commercial product.

The present invention also comprises a method of using concentrated liquid or solid fabric color care compositions, which are diluted to form compositions with the usage concentrations, as given hereinabove, for use in the "usage conditions". Concentrated compositions comprise a higher level of fabric color care active, typically from about 1% to about 99%, preferably from about 2% to about 65%, more preferably from about 3% to about 25%, by weight of the concentrated fabric color care composition. Concentrated compositions are used in order to provide a less expensive product per use. The concentrated product is preferably diluted with about 50% to about 10,000%, more preferably from about 50% to about 8,000%, and even more preferably from about 50% to about 5,000%, by weight of the composition, of water.

The compositions of the present invention can also be used as ironing aids. An effective amount of the composition can be sprayed onto fabric and the fabric is ironed at the normal temperature at which it should be ironed. The fabric can either be sprayed with an effective amount of the composition, allowed to dry and then ironed, or sprayed and ironed immediately.

In a still further aspect of the invention, the composition can be sprayed onto fabrics in an enclosed chamber containing the fabric to be de-wrinkled and/or treated for the color restoration/rejuvenation benefit, thereby providing ease of operation. Examples of an enclosed chamber include a closed flexible bag, such as a plastic bag which is similar to a garment bag, preferably with a flexible opening which can be zipped up, or a cabinet or similar apparatus, with a door hingedly attached. Any spraying mechanism can be used to apply the fabric color care composition to fabrics. A preferred distribution of the garment care composition is achieved by using a fog form. The mean particulate diameter size of the fabric color care composition fog is preferably from about 3 microns to about 50 microns, more preferably from about 5 microns to about 30 microns, and most preferably from about 10 microns to about 20 microns.

Another aspect of the present invention is the method of using an aqueous or solid, preferably powder, fabric color care composition for treating fabric in the rinse step, comprising an effective amount of said fabric color care active, and optionally, perfume, fabric softener active, chlorine scavenging agent, dye transfer inhibiting agent, chemical stabilizer including antioxidant, antimicrobial actives and/or preservative, chelating agent, aminocarboxylate chelating agent, brighteners, soil release agents or mixtures thereof. The rinse water should contain typically from about 0.0005% to about 1%, preferably from about 0.0008% to about 0.1%, more preferably from about 0.001% to about 0.02% of the fabric color care active.

The present invention also relates to a method for treating fabric in the drying step, comprising an effective amount of said fabric color care active, and optionally, perfume, fabric softener active, dye transfer inhibiting agents, dye fixing agent, chemical stabilizer including antioxidant, antimicrobial active and/or preservative, aminocarboxylate chelating agent, brightener, soil release agent, and mixtures thereof. A preferred method comprises the treatment of worn, faded fabrics with a fabric color care composition dispensed from a sprayer at the beginning and/or during the drying cycle. It is preferable that the treatment is performed in accordance with the instructions for use, to ensure that the consumer knows what benefits can be achieved, and how best to obtain these benefits.

All percentages, ratios, and parts herein, in the Specification, Examples, and claims are by weight and are the normal approximations unless otherwise stated.

The following are examples of the instant composition. The following compositions are prepared by mixing and dissolving the ingredients into clear or translucent solutions.

EXAMPLE I

| Ingredients | Ia Wt. % | Ib Wt. % | Ic Wt. % | Id Wt. % | Ie Wt. % | If Wt. % |
|---|---|---|---|---|---|---|
| Arabinogalactan A[1] | 1 | — | — | — | — | — |
| Arabinogalactan B[2] | — | 0.7 | — | — | 0.5 | — |
| Arabinogalactan C[3] | — | — | 0.5 | — | — | 0.5 |
| Curdlan[4] | — | — | — | 1 | — | — |
| Dextran[5] | — | — | — | — | 0.8 | — |
| Carrageenan | — | — | — | — | — | 1 |
| Perfume | 0.1 | 0.05 | 0.07 | 0.1 | 0.05 | 0.05 |
| Polysorbate 60[6] | 0.2 | 0.1 | 0.15 | 0.2 | 0.1 | 0.1 |
| Kathon CG | 3 ppm | 3 ppm | 3 ppm | 3 ppm | 3 ppm | 3 ppm |
| Deionized Water | Bal. | Bal. | Bal. | Bal. | Bal. | Bal. |

[1]Arabinogalactan fraction that has the average molecular weight of from about 16,000 to about 20,000.
[2]Arabinogalactan fraction that has the average molecular weight of about 100,000.
[3]Arabinogalactan fraction that has the average molecular weight of from about 10,000 to about 150,000.
[4]Average molecular weight of about 72,000.
[5]Average molecular weight of about 40,000.
[6]A mixture of stearate esters of sorbitol and sorbitol anhydride, consisting predominantly of the monoester, condensed with about 20 moles of ethylene oxide.

EXAMPLE II

| Ingredients | IIa Wt. % | IIb Wt. % | IIc Wt. % | IId Wt. % | IIe Wt. % | IIf Wt. % |
|---|---|---|---|---|---|---|
| Arabinogalactan A[1] | 5 | — | — | 5 | — | — |
| Arabinogalactan B[2] | — | 15 | — | — | 15 | — |
| Arabinogalactan C[3] | — | — | 25 | — | — | 25 |
| Perfume | — | — | — | 0.3 | 1 | 1.5 |
| Polysorbate 60 | — | — | — | 0.5 | 1.5 | 3 |
| Kathon CG | 5 ppm | 5 ppm | 10 ppm | 5 ppm | 5 ppm | 10 ppm |
| Deionized Water | Bal. | Bal. | Bal. | Bal. | Bal. | Bal. |

Concentrated compositions of Examples II are diluted with water to obtain usage compositions for, e.g., spraying, soaking, dipping, cellulosic fabrics.

EXAMPLE III

| Ingredients | IIIa Wt. % | IIIb Wt. % |
|---|---|---|
| Silwet L-7001 | 1 | — |
| Silwet L-7200 | — | 0.8 |
| Perfume C | 0.05 | 0.1 |
| Polysorbate 60 | 0.1 | 0.2 |
| Kathon CG | 3 ppm | 3 ppm |
| Deionized Water | Bal. | Bal. |

EXAMPLE IV

| Ingredients | IVa Wt. % | IVb Wt. % | IVc Wt. % |
|---|---|---|---|
| Copolymer A[7] | 0.7 | — | — |
| Copolymer B[8] | — | 0.8 | — |
| Silicone Emulsion A[9] | — | — | 3 |
| Perfume | 0.06 | 0.05 | 0.05 |
| Polysorbate 60 | 0.1 | 0.1 | 0.1 |
| Silwet L-7602 | 0.5 | — | — |
| Kathon CG | 3 ppm | 3 ppm | 3 ppm |
| Deionized Water | Bal. | Bal. | Bal. |

[7]Acrylic acid/tert-butyl acrylate copolymer, with an approximate acrylic acid/tert-butyl acrylate weight ratio of about 25/75 and an average molecular weight of from about 70,000 to about 100,000.
[8]Acrylic acid/tert-butyl acrylate copolymer, with an approximate acrylic acid/tert-butyl acrylate weight ratio of about 35/65 and an average molecular weight of from about 60,000 to about 90,000.
[9]DC-2-5932 silicone microemulsion (25% active) from Dow Corning, with a particle size of about 24 nm, a cationic surfactant system, and a silicone with an internal phase viscosity of about 1,200 cps.

EXAMPLE V

| Ingredients | Va Wt. % | Vb Wt. % | Vc Wt. % | Vd Wt. % | Ve Wt. % |
|---|---|---|---|---|---|
| Arabinogalactan A[1] | 1.2 | — | — | — | 5 |
| Copolymer E[10] | — | 0.5 | — | — | — |
| Copolymer F[11] | 0.2 | — | 0.5 | — | — |
| Copolymer G[12] | — | — | — | 0.5 | — |
| PDMS 10,000 cst | — | — | — | 0.3 | — |
| Silicone Emulsion B[13] | — | — | 1 | — | 2 |
| Perfume | — | — | 0.04 | — | 0.5 |
| Polysorbate 60 | 0.1 | 0.1 | — | 0.1 | 0.5 |
| Neodol 23-3 | — | 0.25 | — | 0.2 | — |
| Neodol 25-3 | 0.2 | — | 0.6 | — | 0.3 |
| Silwet L-77 | 0.6 | 0.7 | — | 1 | — |
| Silwet L-7604 | — | — | 0.5 | — | — |
| Kathon CG | 3 ppm | 3 ppm | 3 ppm | 3 ppm | 3 ppm |
| Deionized Water | Bal. | Bal. | Bal. | Bal. | Bal. |

[10]Silicone-containing copolymer having t-butyl acrylate/acrylic acid/(polydimethylsiloxane macromer, 10,000 approximate molecular weight) monomer at an approximate 63/20/17 weight ratio, and of an average molecular weight of about 130,000.
[11]Silicone-containing copolymer having t-butylacrylate/acrylic acid/(polydimethylsiloxane macromer, 10,000 approximate molecular weight) monomer at an approximate 65/25/10 weight ratio, and of average molecular weight of about 200,000.
[12]Silicone-containing copolymer having (N,N,N-trimethylammonioethyl methacrylate chloride)/N,N-dimethylacrylamide/(PDMS macromer - 15,000 approximate molecular weight) at an approximate 40/40/20 weight ratio, and of average molecular weight of about 150,000.
[13]DC-1550 silicone microemulsion (25% active) from Dow Corning, with a particle size of about 50 nm, an anionic/nonionic surfactant system, and a silicone with an internal phase viscosity of about 100,000 cps.

The composition of Example Ve is a concentrated composition, to be diluted for use.

| Ingredients | VI Wt % |
|---|---|
| GE 176-12669 Silicone Emulsion (1) | 1.43 |
| GE SM 2658 Silicone Emulsion (2) | 1.43 |
| Polyvinyl alcohol (3) | 0.065 |
| Glycerin | 0.01 |
| Kathon CG | 3 ppm |
| Perfume | 0.1 |
| Distilled water | Bal. |

(1) Cationic emulsion of hydroxy silicone, about 35% active.
(2) Cationic emulsion of amino-functional silicone, about 35% active.
(3) Weight average molecular weight range from about 18,000 to about 27,000.

The compositions of Examples I to VI (diluted when appropriate) are sprayed onto worn, faded color clothing using, e.g., the TS-800 sprayer from Calmar, and allowed to evaporate off of the clothing.

The compositions of Examples I to VI (diluted when appropriate) are sprayed onto worn, faded color clothing, using a blue inserted Guala® trigger sprayer, available from Berry Plastics Corp. and a cylindrical Euromist II® pump sprayer available from Seaquest Dispensing, respectively, and allowed to evaporate off of the clothing.

The compositions of Examples I to VI (diluted when appropriate) contained in rechargeable battery-operated Solo Spraystar sprayers are sprayed onto large worn, faded color fabric surfaces of fabric, i.e., several pieces of clothing, and allowed to evaporate off of these surfaces. The level of coverage is uniform and the ease and convenience of application is superior to conventional manually operated trigger sprayers.

The compositions of Examples I to VI (diluted when appropriate) are used for soaking or dipping of worn, faded color fabrics which are then optionally wrung or squeezed to remove excess liquid and subsequently dried.

What is claimed is:

1. A method for restoring and/or rejuvenating color of a worn, faded color fabric, wherein said method comprises applying an effective amount of a fabric color care active to said fabric, wherein said fabric color care active is selected from the group consisting of:

(i) polysaccharides selected from the group consisting of: heteropolysaccharides; algal polysaccharides; microbial polysaccharides; lipopolysaccharides; fungal polysaccharides; animal polysaccharides; and mixtures thereof;

(ii) water soluble and/or water dispersible synthetic polymer selected from the group consisting of homopolymer of hydrophilic monomers; homopolymer of hydrophobic monomers; copolymer of hydrophilic monomers and hydrophobic monomers; and mixtures thereof; wherein said hydrophilic monomers are selected from the group consisting of: acrylic acid; methacrylic acid; crotonic acid; maleic acid and its half esters; itaconic acid; salts of said acids; vinyl alcohol; allyl alcohol; vinyl pyrrolidone; vinyl caprolactam; vinyl pyridine; vinyl imidazole; vinyl sulfonate; N,N-dimethylacrylamide; N-t-butyl acrylamide; hydroxyethyl methacrylate; dimethylaminoethyl methacrylate; and mixtures thereof; and wherein said hydrophobic monomers are selected from the group consisting of: methyl acrylate; ethyl acrylate; t-butyl acrylate; methyl methacrylate; 2-ethyl hexyl methacrylate; methoxy ethyl methacrylate; vinyl acetate; vinyl propionate; vinyl neodecanoate; styrene; t-butyl styrene; vinyl toluene; methyl vinyl ether; vinyl chloride; vinylidene chloride; ethylene; propylene; other unsaturated hydrocarbons; and mixtures thereof;

(iii) fabric softening actives capable of forming a bilayer structure, wherein said fabric softening activves are biodegradable and have with highly unsaturated and/or branched hydrophobic chains; and (iv) mixtures thereof;

and wherein the color restoration and/or rejuvenation is characterized by the ability of said active to change the properties of a worn, faded black cotton (chino) twill test fabric, resulting in:

(A) a percentage reflectance reduction ΔR of at least about 5%;

(B) a Hunter L value reduction ΔL of at least about 1.0; and (C) a percentage pill number reduction ΔP of at least at least about 20%.

2. The method according to claim 1, wherein said percentage reflectance reduction ΔR is at least about 8%.

3. The method according to claim 1, wherein said percentage reflectance reduction ΔR is at least about 10%.

4. The method according to claim 1, wherein said Hunter L value reduction ΔL is at least about 1.5.

5. The method according to claim 1, wherein said Hunter L value reduction ΔL is at least about 2.0.

6. The method according to claim 1, wherein said percentage pill number reduction ΔP is at least about 40%.

7. The method according to claim 1, wherein said percentage pill number reduction ΔP is at least about 80%.

8. The method according to claim 1, wherein said percentage reflectance reduction ΔR is at least about 10%, wherein said Hunter L value reduction ΔL is at least about 2.0, and wherein said percentage pill number reduction ΔP is at least about 80%.

9. A method for restoring and/or rejuvenating color of a worn, faded color fabric, wherein said method comprises applying an effective amount of a fabric color care active to said fabric, wherein said fabric color care active is chosen from:

(i) a polysaccharide;

(ii) a water soluble and/or water dispersible synthetic polymer;

(iii) a fabric softening active capable of forming a bilayer structure; and (iv) a mixture thereof;

and wherein the color restoration and/or rejuvenation is characterized by the ability of said active to change the properties of a worn, faded black cotton (chino) twill test fabric, resulting in:

(A) a percentage reflectance reduction ΔR of at least about 3%;

(B) a Hunter L value reduction ΔL of at least about 0.5; and (C) a percentage pill number reduction ΔP of at least about 10%.

10. The method according to claim 9, wherein said percentage reflectance reduction ΔR is at least about 5%.

11. The method according to claim 9, wherein said percentage reflectance reduction ΔR is at least about 8%.

12. The method according to claim 9, wherein said percentage reflectance reduction ΔR is at least about 10%.

13. The method according to claim 9, wherein said Hunter L value reduction ΔL is at least about 1.0.

14. The method according to claim 9, wherein said Hunter L value reduction ΔL is at least about 1.5.

15. The method according to claim 9, wherein said Hunter L value reduction ΔL is at least about 2.0.

16. The method according to claim 9, a percentage pill number reduction ΔP is at least about 20%.

17. The method according to claim 9, a percentage pill number reduction ΔP is at least about 40%.

18. The method according to claim 9, a percentage pill number reduction ΔP is at least about 80%.

19. The method according to claim 9, wherein said percentage reflectance reduction ΔR is at least about 10%, wherein said Hunter L value reduction ΔL is at least about 2.0, and wherein said percentage pill number reduction ΔP is at least about 80%.

20. A method for restoring and/or rejuvenating color of a worn, faded color fabric, wherein said method comprises applying an effective amount of a fabric color care active to said fabric, and wherein the color restoration and/or rejuvenation is characterized by the ability of said active to change the properties of a worn, faded black cotton (chino) twill test fabric, resulting in:

(A) a percentage reflectance reduction ΔR of at least about 3%;

(B) a Hunter L value reduction ΔL of at least about 0.5; and (C) a percentage pill number reduction ΔP of at least about 10%.

21. The method according to claim 20; wherein said fabric care active is present in a fabric color care composition; wherein said fabric care composition is applied onto said fabric as droplets using a spray dispenser; and said droplets have a weight average diameter of from about 5 μm to about 250 μm.

22. The method according to claim 21, wherein said droplets have a weight average diameter of from about 10 μm to about 120 μm.

23. The method according to claim 20, wherein said fabric is dipped and/or soaked in a composition comprising said fabric care active.

* * * * *